US009359688B1

(12) United States Patent
Chua et al.

(10) Patent No.: US 9,359,688 B1
(45) Date of Patent: Jun. 7, 2016

(54) APPARATUSES AND METHODS FOR CONTROLLING PH IN ELECTROPLATING BATHS

(71) Applicant: Novellus Systems, Inc., Fremont, CA (US)

(72) Inventors: Lee Peng Chua, Beaverton, OR (US); Thomas A. Ponnuswamy, Sherwood, OR (US); Mark Rea, Tigard, OR (US); Steven T. Mayer, Lake Oswego, OR (US)

(73) Assignee: Novellus Systems, Inc., Fremont, CA (US)

( * ) Notice: Subject to any disclaimer, the term of this patent is extended or adjusted under 35 U.S.C. 154(b) by 436 days.

(21) Appl. No.: 13/706,296

(22) Filed: Dec. 5, 2012

(51) Int. Cl.
*C25D 21/14* (2006.01)
*C25D 3/12* (2006.01)
*C25D 7/12* (2006.01)

(52) U.S. Cl.
CPC *C25D 21/14* (2013.01); *C25D 3/12* (2013.01); *C25D 7/12* (2013.01)

(58) Field of Classification Search
CPC ..... C25D 21/12–21/18; C25D 3/12–3/18; C25D 7/12–7/126; C25B 1/04–1/12
USPC ..... 205/80–315
See application file for complete search history.

(56) References Cited

U.S. PATENT DOCUMENTS 4,554,056 A * 11/1985 Whitford ..... 205/60
4,715,938 A * 12/1987 Billings ..... 205/629
4,726,888 A * 2/1988 McCambridge ..... 205/630
4,778,572 A * 10/1988 Brown ..... 205/96
6,527,920 B1 3/2003 Mayer et al.
6,551,487 B1 4/2003 Reid et al.
6,800,187 B1 10/2004 Reid et al.
6,821,407 B1 11/2004 Reid et al.

(Continued)

FOREIGN PATENT DOCUMENTS

JP 2007169700 A 7/2007

OTHER PUBLICATIONS

U.S. Appl. No. 13/960,624, filed Aug. 6, 2013, entitled "Apparatuses and Methods for Maintaining PH in Nickel Electroplating Baths."

(Continued)

*Primary Examiner* — James Lin
*Assistant Examiner* — Ho-Sung Chung
(74) *Attorney, Agent, or Firm* — Weaver Austin Villeneuve & Sampson LLP

(57) ABSTRACT

Disclosed are methods of electroplating a metal onto a substrate surface in an electroplating bath and adjusting the pH of the bath. The methods may include exposing the substrate surface, a counter-electrode, and an acid generating surface to the bath, biasing the substrate surface sufficiently negative relative to the counterelectrode such that metal ions from the bath are reduced and plated onto the substrate surface, and biasing the acid generating surface sufficiently positive relative to the counterelectrode such that free hydrogen ions are generated at the acid generating surface thereby decreasing the pH of the bath. Also disclosed are apparatuses for electroplating metal onto a substrate surface in an electroplating bath, and for adjusting the pH of the electroplating bath. The apparatuses may include an acid generating surface configured to generate free hydrogen ions in the bath upon supply of sufficient positive voltage bias relative to a counterelectrode electrical contact.

15 Claims, 9 Drawing Sheets

(56) References Cited

U.S. PATENT DOCUMENTS

| | | | | |
|---|---|---|---|---|
| 8,262,871 | B1 | 9/2012 | Mayer et al. | |
| 8,308,931 | B2 | 11/2012 | Reid et al. | |
| 2003/0178315 | A1* | 9/2003 | Taylor | 205/103 |
| 2005/0230262 | A1* | 10/2005 | Chen | 205/122 |
| 2006/0032758 | A1* | 2/2006 | Klocke et al. | 205/219 |
| 2006/0144699 | A1* | 7/2006 | Klocke | 204/228.6 |
| 2010/0320081 | A1 | 12/2010 | Mayer et al. | |
| 2010/0320609 | A1 | 12/2010 | Mayer et al. | |
| 2011/0056840 | A1 | 3/2011 | Isono et al. | |
| 2012/0064462 | A1 | 3/2012 | Willey et al. | |
| 2012/0175263 | A1 | 7/2012 | Ganesan et al. | |
| 2013/0284604 | A1 | 10/2013 | Spurlin et al. | |
| 2013/0313123 | A1 | 11/2013 | Abraham et al. | |

OTHER PUBLICATIONS

U.S. Appl. No. 14/256,872, filed Apr. 18, 2014, entitled "Methods and Apparatuses for Electroplating Nickel Using Sulfur-Free Nickel Anodes."

U.S. Appl. No. 14/256,883, filed Apr. 18, 2014, entitled "Nickel Electroplating Systems Having a Grain Refiner Releasing Device."

* cited by examiner

APPARATUSES AND METHODS FOR CONTROLLING PH IN ELECTROPLATING BATHS

BACKGROUND

Nickel sulfamate baths are a common electrolyte formulation used in many advanced nickel plating applications such as various wafer level packaging (WLP) applications, and various engineering applications where low stress films are a requirement. These baths are typically composed of dissolved nickel sulfamate salts, boric acid, and in some formulations, small amounts of one or more plating additives for changing the deposit surface and stress properties (e.g. saccharin as a film stress reliever and brightener). In some systems, chloride ion is added to help aide and maintain proper dissolution at the nickel anode, particularly when sulfur containing nickel depolarized anode is not used. Typically, the target acidity of these baths is within a pH range broadly of about 3.0 to about 5.0, and sometimes within a more limited range (e.g. 3.5 to 4.5).

In a typical nickel electroplating process flow, such as that employed in a typical wafer level packaging (WLP) application, multiple semiconductor wafers are plated sequentially in each nickel sulfamate bath. Since deviations in bath composition can result in inferior electroplating, poor process performance, and potentially defects in the plated nickel layers, ideally, each wafer is plated under substantially the same process conditions, relatively invariant with time and constant over the plating of numerous wafers. In practice, however, maintaining constant process conditions in nickel sulfamate baths can pose a significant challenge.

SUMMARY OF THE DISCLOSURE

Disclosed herein are methods of electroplating a metal onto a surface of a patterned semiconductor substrate in an electroplating bath and adjusting the pH of the bath. In some embodiments, the methods may include exposing the substrate surface to the bath, exposing a counter-electrode to the bath, exposing an acid generating surface to the bath, biasing the substrate surface sufficiently negative relative to the counterelectrode such that metal ions from the bath are reduced and plated onto the substrate surface, and biasing the acid generating surface sufficiently positive relative to the counterelectrode such that free hydrogen ions are generated at the acid generating surface thereby decreasing the pH of the bath. In certain such embodiments, the metal is nickel.

In some embodiments, free hydrogen ions are generated at the acid generating surface by electrolysis of water molecules in the bath, and in certain such embodiments, the concentration of metal ions in the bath is lowered through electrochemical reduction of a portion of the metal ions to non-ionic metal which plates onto the counterelectrode In certain such embodiments, the electrochemical reduction of a portion of the metal ions occurs in proportion to the charge transferred by generating free hydrogen ions at the acid generating surface.

In some embodiments, the acid generating surface may include an electrically-conductive, corrosion-resistant material which does not substantially corrode in the electroplating bath, and wherein the electrically-conductive, corrosion-resistant material is coated with either platinum, or one or more metal oxides selected from the oxides of platinum, niobium, ruthenium, iridium, and tantalum. In certain such embodiments, the electrically-conductive, corrosion-resistant material is titanium, tantalum, niobium, or zirconium.

Also disclosed herein are methods of electroplating patterned semiconductor substrates in a set of electroplating baths, and adjusting the pH levels of the baths. In some embodiments, the methods include electroplating a metal onto one or more patterned semiconductor substrates in the set of baths, estimating the pH levels of the baths, selecting the bath estimated to have the highest pH level, if the estimated pH level of the selected bath exceeds a threshold maximum pH level, waiting until any electroplating currently underway with respect to a particular substrate in the selected bath has completed, and thereafter initiating a pH correction procedure with respect to the selected bath. In certain such embodiments, the pH correction procedure may include biasing an acid generating surface sufficiently positive relative to a counterelectrode such that free hydrogen ions are generated at the acid generating surface, the free hydrogen ions decreasing the pH level of the selected bath. In certain embodiments, the methods of electroplating in a set of baths and adjusting the pH levels of the baths may further include terminating the pH correction procedure with respect to the selected bath when either the estimated pH level of the selected bath has dropped below a target pH level, or determining that electroplating the next substrate in the selected bath takes precedence over pH correction. In some embodiments, it is determined that electroplating the next substrate in the selected bath takes precedence over pH correction whenever there is no other electroplating bath in the set of electroplating baths immediately available for electroplating, and a substrate which has completed the immediately preceding processing step is ready for electroplating. In some embodiments, the target pH level is substantially equivalent to the threshold maximum pH level. In some embodiments, one or more steps may be repeated one or more times to adjust bath pH levels. In some embodiments, the free hydrogen ions are generated at the acid generating surface by electrolysis of water molecules in the bath. In some embodiments, the metal is nickel.

Other methods of electroplating patterned semiconductor substrates in a set of electroplating baths, and adjusting the pH levels of the baths are also disclosed herein. In some embodiments, the methods include electroplating a metal onto one or more patterned semiconductor substrates in the set of baths, selecting a set of one or more idle baths not currently electroplating a substrate, estimating the pH levels of the set of idle baths, selecting the subset of the set of idle baths having one or more estimated pH levels exceeding a threshold maximum pH level, and for each particular idle bath in the subset of idle baths estimated to have excessive pH, initiating a pH correction procedure. The pH correction procedure may include biasing an acid generating surface sufficiently positive relative to a counterelectrode such that free hydrogen ions are generated at the acid generating surface, the free hydrogen ions decreasing the pH level of the particular idle bath. In certain embodiments, such methods may further include for each particular idle bath in the subset of idle bath estimated to have excessive pH, terminating the pH correction procedure with respect to it when either the estimated pH level of the particular idle bath has dropped below a target pH level, or determining that electroplating the next substrate in the particular idle bath takes precedence over pH correction. In certain such embodiments, it is determined that electroplating the next substrate in the particular idle bath takes precedence over pH correction whenever there is a substrate ready for electroplating and the particular idle bath is the only idle bath, or the particular idle bath has an estimated pH level lower than the other baths of the subset of idle baths estimated to have excessive pH.

Also disclosed herein are acid generating discs for freeing hydrogen ions from water molecules through electrolysis upon application of sufficient positive voltage to the discs while they rest in an electroplating clamshell. In some embodiments, an acid generating disc may include a body comprising an electrically-conductive, corrosion-resistant material which does not substantially corrode in an electroplating bath, and a coating on the body. In some embodiments, the coating includes either platinum, or one or more metal oxides selected from the oxides of platinum, niobium, ruthenium, iridium, and tantalum, and in some embodiments, the disc has a diameter of about 200 mm, or about 300 mm, or about 450 mm. In some embodiments, the electrically-conductive, corrosion-resistant material is titanium, tantalum, niobium, or zirconium, and in some embodiments, the thickness of the disc is between about 0.5 mm and about 5 mm.

Also disclosed herein are electroplating apparatuses for electroplating metal onto a surface of a patterned semiconductor substrate in an electroplating bath, and for adjusting the pH of the electroplating bath. In some embodiments, the apparatus may include an electroplating cell configured to contain the electroplating bath, a mount configured for holding the substrate in the electroplating bath, a substrate electrical contact configured to supply a voltage bias to the substrate while it is held in the mount, a counterelectrode electrical contact configured to supply a voltage bias to a counterelectrode while contacting the counterelectrode, an acid generating surface configured to generate free hydrogen ions in the bath upon supply of sufficient positive voltage bias relative to the counterelectrode electrical contact, and one or more electrical power units configured to supply a negative voltage bias to the substrate electrical contact relative to the counterelectrode electrical contact sufficient to reduce and plate metal ions from the bath onto the substrate surface, and to supply a positive voltage bias to the acid generating surface relative to the counterelectrode electrical contact sufficient to generate free hydrogen ions at the acid generating surface thereby decreasing the pH of the bath. In some embodiments, the metal to be electroplated is nickel. In some embodiments, the free hydrogen ions are generated at the acid generating surface by electrolysis of water molecules in the bath. In some embodiments, the acid generating surface is attached to an interior wall of the electroplating cell, and in some embodiments, the acid generating surface forms a ring on the interior wall of the electroplating cell. In some embodiments, the acid generating surface may include a body comprising an electrically-conductive, corrosion-resistant material which does not substantially corrode in the electroplating bath, and a coating on the body, the coating comprising either platinum or one or more metal oxides selected from the oxides of platinum, niobium, ruthenium, iridium, and tantalum. In certain such embodiments, the electrically-conductive, corrosion-resistant material is titanium, tantalum, niobium, or zirconium.

In some embodiments, the one or more electrical power units of the electroplating apparatus may include a first electrical power unit configured to supply the negative voltage bias to the substrate electrical contact relative to the counterelectrode electrical contact, and a second electrical power unit configured to supply the positive voltage bias to the acid generating surface relative to the counterelectrode electrical contact. In some embodiments, the one or more electrical power units of the electroplating apparatus may include a dual-purpose electrical power unit configured to supply the negative voltage bias to the substrate electrical contact relative to the counterelectrode electrical contact, and also the positive voltage bias to the acid generating surface relative to the counterelectrode electrical contact. In certain such embodiments, the electroplating apparatus may further include a first relay controlling the electrical connection between the dual-purpose electrical power unit and the substrate electrical contact, and a second relay controlling the electrical connection between the dual-purpose electrical power unit and the acid generating surface, wherein during electroplating the first relay is closed and the second relay is open so that the negative voltage bias relative to the counterelectrode electrical contact is supplied to the substrate electrical contact, and wherein during generation of free hydrogen ions at the acid generating surface the first relay is open and the second relay is closed so that the positive voltage bias relative to the counterelectrode electrical contact is supplied to the acid generating surface.

Also disclosed herein are acid generating bath reservoirs for adjusting the pH of an electroplating bath, the electroplating bath used to electroplate metal onto the surface of a patterned substrate. In some embodiments, an acid generating bath reservoir may include a container configured to hold a volume of electroplating bath fluid, a fluidic connector configured for establishing a fluidic connection between the container and an electroplating cell, a counterelectrode electrical contact configured to supply a voltage bias to a counterelectrode disposed within the container while contacting the counterelectrode, an acid generating surface disposed within the container and configured to generate free hydrogen ions in the volume of electroplating bath fluid upon supply of sufficient positive voltage bias relative to the counterelectrode electrical contact, and one or more electrical power units configured to supply a positive voltage bias to the acid generating surface relative to the counterelectrode electrical contact sufficient to generate free hydrogen ions at the acid generating surface thereby decreasing the pH of the volume of electroplating bath fluid. In some embodiments, the metal to be electroplated is nickel. In some embodiments, the free hydrogen ions are generated at the acid generating surface by electrolysis of water molecules in the volume of electroplating bath fluid. In some embodiments, the fluidic connector of the acid generating bath reservoir may include an inlet conduit configured to receive a flow of electroplating bath fluid from the electroplating cell, an outlet conduit configured to send a flow of electroplating bath fluid to the electroplating cell, and a recirculation pump fluidically connected to the inlet and/or outlet conduits and configured to supply fluidic pressure within the inlet and/or outlet conduits, wherein the pH of the electroplating bath fluid flowing within the outlet conduit is lower than the pH of the electroplating bath fluid flowing within the inlet conduit.

In some embodiments, the acid generating surface of the acid generating bath reservoir includes a body comprising an electrically-conductive, corrosion-resistant material which does not substantially corrode in the electroplating bath fluid, and a coating on the body, the coating comprising either platinum or one or more metal oxides selected from the oxides of platinum, niobium, ruthenium, iridium, and tantalum. In certain such embodiments, the electrically-conductive, corrosion-resistant material is titanium, tantalum, niobium, or zirconium.

DETAILED DESCRIPTION

Nickel deposition and electroplating finds various applications in semiconductor fabrication. For instance, electroplated nickel is particularly important in wafer-level packaging (WLP) applications where it finds common use. However, to ensure consistent and high-quality nickel plating, it is important that the electroplating bath composition and plating process conditions remain substantially constant over the course of sequentially plating many wafers. Unfortunately, it is oftentimes true that nickel electroplating bath pH levels tend to drift upward over the course of time and/or over the course of multiple wafer plating operations.

For instance, nickel-sulfamate-based electroplating baths, despite their widespread use, tend to have relatively poor pH stability. Specifically, pH tends to drift upwards substantially monotonically, and in some cases proportionally, with the time spent electroplating and/or with the total amount of nickel electroplated—e.g. measured as total charge plated.

Figure 5A:
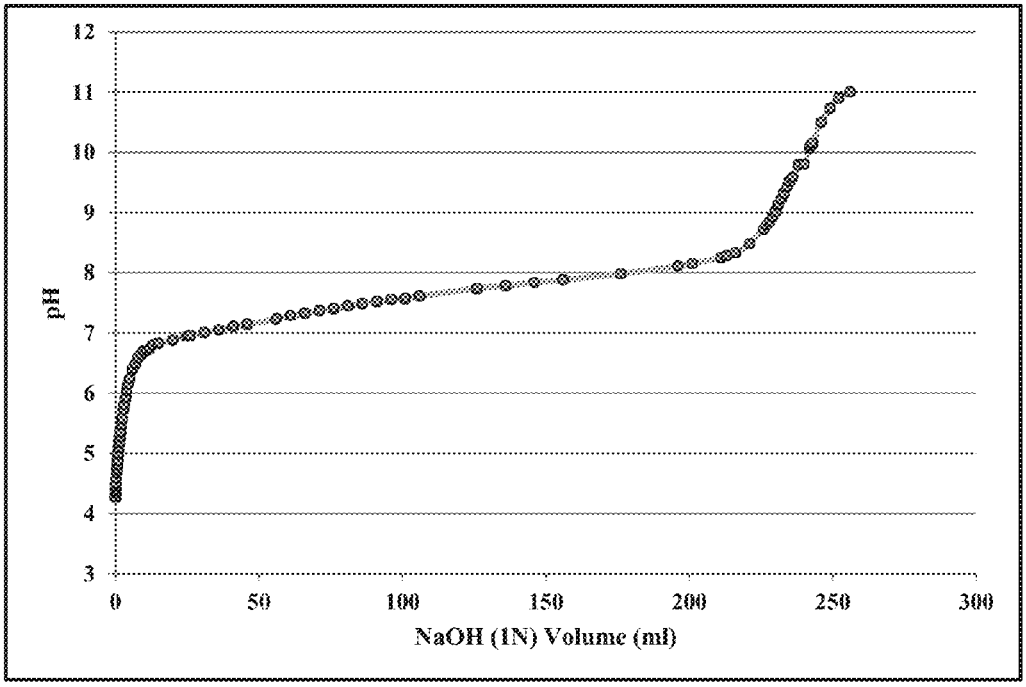
FIG. 5A displays a plot of a nickel plating bath titration showing the pH level of the bath versus the amount of sodium hydroxide added to the bath.

For instance, FIG. 5A shows the titration of a plating bath containing 75 g/L nickel sulfamate and 30 g/L Boric Acid (the pH of the bath versus the addition of sodium hydroxide). The bath as a whole is seen to be unbuffered at the common (fresh) operating pH of around 4.0. Small additions of alkali cause large and rapid increases in pH. While not being limited to any particular model or theory, it is believed that the bath at pH 4.0 exists as nickel sulfamate and fully protonated boric acid. A small amount of base increases the pH of the solution because boric acid is a weak acid with a pKa (9.2) that is much higher than the typical bath pH of around 4.0. A solution of boric acid in water has a pH of approximately 4.0. With addition of alkali, the pH of a bath therefore increases rapidly to around 6.5, whereupon the rate of pH increase decreases due to the precipitation of Ni ions as NiO and/or $Ni(OH)_2$, which can be visually observed. Further addition of base eventually cause substantially all the nickel to be precipited until the pH of approximately 8.3, above which a rapid pH increase is observed until a value around the boric acid pKa is reached.

Again, without being limited to a particular theory, it is believed that boric acid can serve a purpose as a interfacial buffer, even though it offers very little buffering of the solution as a whole. Its role in the bath, and particularly, at the plated interface, can be significant in preventing a pH increase to 6.5 or greater at the plating interface, and thereby substantially avoiding formation of a precipitated nickel oxide or hydroxide interfacial layer that may interfere with the process of deposition and the quality of the surface and film. In some cases, the boric acid can achieve this result as long as the rate of release of protons from the non-ionized compound, or the rate of reaction of the non-ionized weak acid compound with generated hydroxide ions, is sufficiently greater, or fast enough to compensate, for the rate of proton ion consumption (or hydroxyl ion generation) at the interface (as a minor side reaction to the nickel deposition process). These reactions (Reactions 1 and 2 below) occur because they are thermodynamically feasibly (because nickel deposition occurs at a slightly more cathodic potential than the formation of hydrogen), but are small in magnitude because they are kinetically inhibited.

$$Ni^{+2}+2e^{-}\rightarrow Ni \quad \text{(Reaction 1)}$$

$$2H^{+}+2e^{-}\rightarrow H_2 \quad \text{(Reaction 2)}$$

$$2H_2O+2e^{-}\rightarrow 2OH^{-}+H_2 \quad \text{(Reaction 3)}$$

In addition to these pH changing electrolytic process, other processes may also result in pH drift in nickel-sulfamate baths, and so they have been investigated, and several mechanisms are postulated which may either alone or in combination be responsible for the consumption of bath hydrogen ions ($H^{+}$). One possible mechanism is related to the fact that nickel anodes initially can have, and most likely will have, one or more oxidized or carbonated layers on their surface. When these oxidized or carbonated layers contact the electrolyte, they are etched off releasing $Ni^{2+}$ and consuming $H^{+}$. For instance, Reactions 4 through 6 below are likely to occur at the surface of oxidized or carbonated nickel anodes when they contact an acidic electrolyte plating solution:

$$NiO(s)+2H^{+}\rightarrow Ni^{2+}+H_2O \quad \text{(Reaction 4)}$$

$$Ni(CO_3)+H^{+}\rightarrow Ni^{2+}+HCO_3^{-} \quad \text{(Reaction 5)}$$

$$Ni(HCO_3)_2+2H^{+}\rightarrow Ni^{2+}+2H_2CO_3 \quad \text{(Reaction 6)}$$

Another potential mechanism of hydrogen ion consumption stems from the fact that even without the presence of oxidized or carbonated layers, or if these layers have already been etched away, bare nickel may be etched away via oxygen induced corrosion (oxygen reduction and nickel oxidation, Reaction 7) or direct acid induced corrosion (free proton reduction, and nickel oxidation, Reaction 8), each of which consumes free protons in the bath:

$$O_2+Ni(s)+4H^{+}\rightarrow Ni^{2+}+2H_2O \quad \text{(Reaction 7)}$$

$$Ni(s)+2H^{+}\rightarrow Ni^{2+}+H_2(g) \quad \text{(Reaction 8)}$$

As above and in addition, acid protons may also be consumed at the cathode. Since nickel plating at the working cathode (Reaction 1 and 9) is not 100% kinetically efficient (and in contrast, the nickel electrolytic corrosion reaction at the anode is nearly 100% efficient), acid protons may be consumed (or water decomposed) through hydrogen gas evolution (Reactions 2, 3 and 10).

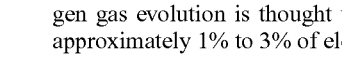

$$Ni^{2+}+2e^{-}\rightarrow Ni(s) \quad \text{(Reaction 9, ~97-99\%)}$$

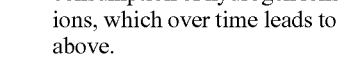

$$2H^{+}+2e^{-}H_2(g) \quad \text{(Reaction 10, ~1-3\%)}$$

As indicated in the text next to Reactions 9 and 10, hydrogen gas evolution is thought to be responsible for perhaps approximately 1% to 3% of electron consumption occurring at the cathode. Each of these mechanisms involves the net consumption of hydrogen ions ($H^{+}$) or formation of hydroxyl ions, which over time leads to the upward pH drift described above.

However, the mechanisms at work in Reactions 1 through 10 above may also be responsible for another problem which accompanies the pH drift described above, and that is the production of excess nickel ions, $Ni^{2+}$, in the electroplating bath. Nickel ion concentration is another bath parameter which is ideally maintained within some optimal range. Since Reactions 4 through 8 generate $Ni^{2+}$, as well as the net difference between the electrolytic anodization of the anode versus the cathode, these reactions have the potential to shift nickel ion concentration away from its optimal range.

Figure 5B:
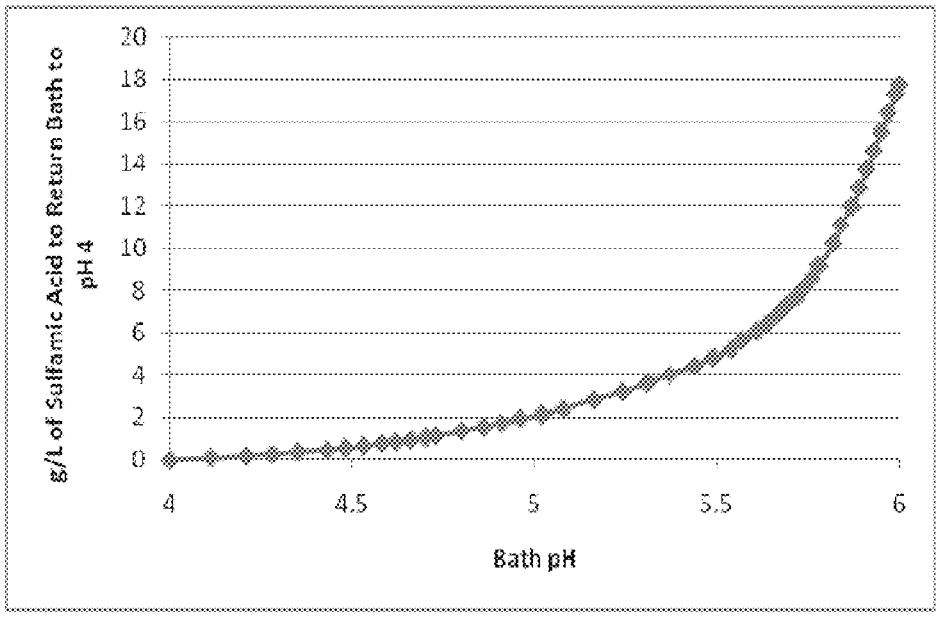
FIG. 5B displays a plot of a nickel plating bath acid titration and illustrates the amount of sulfamic acid required to restore the bath back to a pH of 4.

One possible method of addressing the consumption of $H^{+}$ ions, is through periodically dosing of the bath with sulfamic acid. FIG. 5B shows the amount of sulfamic acid required to restore a bath (again having a composition of 75 g/L nickel sulfamate and 30 g/L boric acid) from a pH of greater than 4 back to a pH of 4. As seen in FIG. 5B, the amount of moderate to strong acid with a pKa less than 4 needed increases considerably the further the solution is from the target pH of 4. In this example, sulfamic acid was added as a dissolved compound from an aqueous solution. Sulfamic acid is a solid with limited long term stability in aqueous solutions. Also, adding sulfamic acid does not address the bath control issue of continual excess production of $Ni^{2+}$. Thus, in principle, it is possible to adjust bath pH, and prevent its rise, through estimates, calculations, measurements and corrective regular dosing with sulfamic acid. Unfortunately, in practice, regular dosing with sulfamic acid poses several complications. These complications, to some extent, stem from the short shelf life of sulfamic acid, which is caused by the fact that it hydrolyzes over time to form ammonium bisulfate salts (as shown in Reaction 11), as well as the net imbalance in the process for nickel ion.

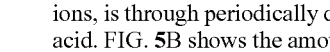

$$H_3NSO_3+H_2O\rightarrow NH_4^{+}+HSO_4^{-} \quad \text{(Reaction 11)}$$

Solid sulfamic acid is stable and non-hygrosopic. But handling and dosing solids is undesireable. Because aqueous sulfamic acid solutions decomposes relatively rapidly, a solution of it typically must be prepared shortly before its use from its solid form. If it is not freshly prepared, and oftentimes even if it is, auto-dosing control presents a formidable predictive challenge because the actual concentration of sulfamic acid in the aqueous solution is constantly decreasing. Furthermore, dosing with sulfamic acid to control pH does not address the issue of the excess $Ni^{2+}$ metal ions accumulating in the bath. In addition, repeated sulfamic acid dosing may increase the sulfamate anion concentration beyond the preferred range for the plating bath. In either case, due to excess $Ni^{2+}$, or excess $H_2NSO_3^{-}$, or both, the bath will require full or partial replacement, such as by employing a bleed and feed scheme, or the like. Thus, from a practical standpoint, dosing with sulfamic acid to control pH drift is problematic.

Accordingly, due to the importance of maintaining electroplating bath pH within relatively narrow margins, methods and apparatuses for controlling and correcting bath pH have been developed and they are disclosed herein. In some embodiments, these methods and apparatuses initiate a pH correction procedure if the pH level of the bath is determined to be, or likely to be, beyond some threshold pH level. In some embodiments, this threshold pH level may be about pH 2.5, pH 2.6, pH 2.7, pH 2.8, pH 2.9, pH 3.0, pH 3.1, pH 3.2, pH 3.3, pH 3.4, pH 3.5, pH 3.6, pH 3.7, pH 3.8, pH 3.9, pH 4.0, pH 4.1, pH 4.2, pH 4.3, pH 4.4, pH 4.5, pH 4.6, pH 4.7, pH 4.8, pH 4.9, pH 5.0, pH 5.1, pH 5.2, pH 5.3, pH 5.4, pH 5.5, pH 6.0, pH 6.5, or about pH 7.0. In addition, in some embodiments, these methods and/or apparatuses may work to eliminate some portion of any excess metal cations present in the bath—$Ni^{2+}$ ions, for example, as produced by reactions listed above.

Since Reactions 2 through 8 and 10 consume hydrogen ions or generate hydroxyl ions, various pH correction procedures disclosed herein combat pH drift by generating hydrogen ions. In some embodiments, free hydrogen ions are generated in the electroplating bath by electrolyzing one or more components of the electroplating bath. For instance, water is typically used as a solvent in nickel plating baths, and the electrolysis of water at an electron-adsorbing anode submersed in the bath generates four hydrogen ions and one oxygen molecule for every two water molecules electrolyzed:

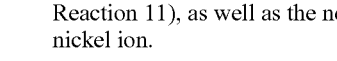

$$2H_2O(l)\rightarrow O_2(g)+4H^{+}+4e^{-} \quad \text{(Reaction 12)}$$

The four freed electrons are, of course, adsorbed by the anode, and they may serve a second beneficial purpose, as described in detail below. The corresponding cathodic reaction for Reaction 12 is generally the reduction of nickel (at the wafer itself, or more generally at an auxiliary cathode).

The anode used to adsorb the electrons generated by Reaction 12 may be an inert auxiliary anode, and it may be embodied in a variety of shapes, sizes, and configurations, it may be made from and/or coated with a variety of materials, and it may be exposed to the bath at a variety of locations within the electroplating cell. It is referred to here as an auxiliary anode because an electroplating cell typically already has another anodic electrode (typically this other anode is the main anode and is an active (non-inert) nickel metal anode which serves as a source of the metal to be electroplated onto some target cathodic surface—typically a wafer substrate). Moreover, since the generation of free hydrogen ions in the bath occurs through a reaction occurring at or near the surface of the auxiliary anode (e.g. the electrolysis of Equation 12), the auxiliary anode is generally referred to herein as an acid generating surface or "AGS."

As mentioned above, the cathodic plating efficiency, as mentioned above, typically 97-99%, is generally lower and less efficient than the main anode metal half reaction (often nearly 100% efficient), leading to overall inefficiency, and an increase in metal content and increase in pH of the bath. If one were to use an inert anode undergoing reaction 12, instead of a metallic anode, then the anodic efficiency for metal generation at the main anode would be zero (0%) and the metal content in the bath would decrease and the pH would decrease over time. Therefore, these two main anode approaches (active vs. inert) lead to contrary results in bath pH and metal content over time. The net overall efficiency for the latter case (active metal anode) is much closer to balance, but is not perfect. By using a small amount of AGS inert anode reaction while plating, one can fairly rapidly restore the metal and acid/pH balance. Because the cathodic plating inefficiency is not necessarily constant in time or with processing condition, nor can it be easily predicted with absolutely certainty over very long periods of time (several months or a year), a means of not only predicting the amount of charge required to pass on the AGS versus time is required, but also some measurement of metal and bath pH may be needed periodically to control the bath composition. Some embodiments disclosed herein therefore enable a technique wherein a relatively small amount of charge (compared to that plated on the workpieces) is passed using an AGS configuration (an inert anode oxygen electrode coupled with a metal deposition cathode) to restore the balance from the typically 97-99% efficiency and an associated pH rise and metal decrease, and includes a periodic use of an AGS, coupled though predictions of inefficiencies, and/or measurements of the pH and/or metal content in the bath, to turn on the AGS system periodically until the pH and/or metal content of the bath is restored to the target values.

In order for it to perform its acid generating function, during acid generation, the AGS is typically biased sufficiently positive relative to some AGS counterelectrode (an AGS cathode) such that the AGS can adsorb electrons from the appropriate bath component (after releasing them from the component) and generate free hydrogen ions at its surface. The adsorbed/released electrons may then transverse an external circuit and then be transferred to the AGS cathode surface where they may be adsorbed by (and thereby reduce) another component of the bath. The (AGS) counterelectrode (or AGS cathode) may be one and the same as the counterelectrode used in electroplating operations, or it may be distinct from the counterelectrode used in electroplating operations. However, since in electroplating, the substrate is typically biased negative relative to a main (typically active metal) anode such that metal ions from the bath are reduced and plated onto the substrate surface, during acid generation, some electrical reconfiguration (perhaps by switching various electrical relays) may be required such that the AGS may be biased sufficiently positive relative to this counterelectrode to cause acid generation. In any event, the AGS works to lower the pH of the electroplating bath. Thus, a method of electroplating metal and adjusting bath pH may include exposing a substrate surface and counterelectrode to an electroplating bath, biasing the substrate surface sufficiently negative relative to the counterelectrode such that metal ions are reduced and plated onto the substrate surface, and biasing the AGS sufficiently positive relative to the counterelectrode such that free hydrogen ions are generated. In some embodiments, as described above in reference to Reaction 12, pH adjustment may be accomplished by freeing hydrogen ions through electrolysis of water molecules at the AGS.

As alluded to above, electrons adsorbed by an anodic AGS may serve an additional beneficial purpose. Even with pH correction, there is still the problem of solvated metal cation bath concentration undesirably increasing over time by the same mechanisms which lead to a corresponding decrease in hydrogen ion consumption. However, the electrons adsorbed by the anodic AGS may be used to deal with this problem. By being directed via a conductive path to a cathodic surface in contact with the bath fluid, the electrons adsorbed by the AGS may be used to reduce solvated metal cations in the bath fluid. This reduction of solvated metal ions causes uncharged elemental metal to plate out onto the aforementioned cathodic surface, thereby lowering the metal ion concentration in the bath. Reaction 13 illustrates this for $Ni^{2+}$:

$$Ni^{2+}(l)+2e^{-}\rightarrow Ni(s) \qquad \text{(Reaction 13)}$$

Thus, in some embodiments, the concentration of metal ions in the bath may be effectively lowered through the electrochemical reduction of a portion of the metal ions to a non-ionic metal species which plates out onto the counterelectrode. Furthermore, in some embodiments, the amount of charge used to plate out metal from the bath may be roughly related to the total charge of the electrons freed at the AGS. Moreover, in some embodiments, the electrochemical reduction of some portion of the solvated metal ions may occur roughly or substantially in proportion to the charge transferred by generating free hydrogen ions at the AGS. Accordingly, in some embodiments, the electrolysis occurring at the AGS and the plating of metal onto the cathodic surface substantially balance out, effectively reversing the processes at work in Reactions 4 through 8. Because of this potential balancing, at least in principle, the process of generating hydrogen ions and using a portion or all of the freed electrons to reduce metal ions and plate elemental metal is generally referred to herein as a metal-to-acid (MTA) process. The phrase is used because, to some extent, the aforementioned process results in an effective exchange of metal ions for hydrogen ions in the bath, as illustrated in Reaction 14:

$$2Ni^{2+}(l)+2H_2O(l)\rightarrow 2Ni(s)+O_2(g)+4H^{+} \qquad \text{(Reaction 14)}$$

Of course, it should be understood that the metal-to-acid exchange does not have to be perfect, complete, or even with a defined proportionality for a process to constitute a MTA process as that term is used herein. Stated alternatively, as long as a significant fraction of the electrons freed at an AGS are used to reduce metal ions to a solid form thereby lowering their bath concentration, the process is generally referred to herein as an MTA process. In any event, an MTA process to control pH drift is advantageous because the drift issues described above are most typically accompanied by the generation of excess solvated metal ions—$Ni^{2+}$ for example—and the MTA process has the potential to ideally exchange metal ions for hydrogen ions with the correct proportionality for reversing the imbalance which was created by Reactions 1 through 7 above. And, as an additional potential benefit, for electroplating baths having for whatever reason extraneous metal ions more noble than the metal being electroplated (e.g. $Cu^{2+}$ ions in a $Ni^{2+}$ sulfamate electroplating bath), the plating out of the excess primary metal ion (e.g. $Ni^{2+}$) will be accompanied by the plating out of these extraneous more noble metal ions ($Cu^{2+}$). Thus, in embodiments where this occurs, MTA processes may even further improve electroplating bath composition. As a result, MTA processes enable the extension of the bath life, potentially reducing bleed & feed requirements, as well as obviating the need for any sulfamic acid dosing regimen.

In some embodiments, a typical MTA process may be carried out in a galvanostatic fashion, with current operating between about 0.01 to about 10 amperes per liter (A/L) of electroplating bath fluid, or about 0.05 A/L to about 5 A/L, or about 1 A/L to about 4 A/L. Depending on the embodiment, a suitable amount or duration of an MTA process may be described in terms of the total amount of charge (e.g., in coulombs) to be preferably transferred via the MTA process. In some embodiments, a measurement of pH may be used to estimate the appropriate target charge quantity to be transferred in an MTA process for a given electroplating bath volume to restore the target pH value. In some embodiments, a measurement of metal content may be used to estimate the appropriate target charge quantity to be transferred in an MTA process for a given electroplating bath volume to restore the target pH value or the target metal content. The relationship between target charge quantity and current pH level may be determined experimentally or by literature data and calculations. Current pH level may be measured directly by onboard pH meters, or it may be measured or estimated through the use of off-line bath metrology data. In any event, current pH level or metal content may provide a mechanism of estimating the amount or duration of MTA process appropriate for a given electroplating bath.

However, pH level or metal content are not the only routes to estimating appropriate MTA amount or duration. In some embodiments, systems idle time since the last MTA operation, and/or the charge passed by electroplating processes since the last MTA operation may provide a suitable basis for estimating the amount of charged preferably transferred in a subsequent MTA operation. The target charge quantity to be transferred via a subsequent MTA operation is referred to herein as an "MTA charge deficit," and the relationship between the "MTA charge deficit" and the system idle time and/or the plating charge passed will typically depend on the particular electroplating bath chemistry as well as the design of the electroplating equipment. In some embodiments, the target "MTA charge deficit" to be transferred as a function of plating charge passed or system idle time has already been characterized for a particular system, and so by tracking these quantities, the "MTA charge deficit" may be accumulated during electroplating operations, so that when an opportunity to perform an MTA process arises (such as because of a scheduled gap in electroplating), the appropriate amount or duration of MTA process to preferably execute is known. In certain such embodiments, an MTA process may be queued up in an electroplating apparatus's scheduling control mechanism (e.g. operating software) once a pre-specified minimum MTA charge deficit is met, and once a suitable gap in electroplating operations arises, the appropriate amount or duration of MTA process could be performed to match the known MTA charge deficit (or at least performed for some maximum allowable time, whichever occurs first).

The pH adjustment and/or MTA processes and apparatuses disclosed herein may be generally used, depending on the embodiment, with any metal electroplating system using an active anode whose cathodic plating efficiency is lower than the anodic dissolution efficiency. Therefore, apparatuses and methods disclosed herein are generally potentially applicable to metals and system that are plated at a potential below (or more negative than) the hydrogen evolution potential at pH 0 (0V vs. NHE), and more generally if the metal reduction potential is below the stability of water to form hydrogen at the pH of the bath being used. Some examples of metals in this class of material include nickel, cobalt, indium, zinc, cadmium, chromium, antimony, tin and lead, and alloys of these materials. Examples of plating chemistries whose use may be benefited from the pH adjustment and/or MTA processes and apparatuses disclosed herein include, but are not limited to: iron and iron alloy plating sulfate, sulfamate, chloride, and/or fluoroborate based baths, indium plating sulfamate based baths, acid bromide based cadmium plating baths, and acid chloride zinc plating baths.

The formation of complexes of metal ion in a bath, which drives the potential for reduction to more negative values than the uncomplexed state, can also lead to a net inefficiency and co-hydrogen evolution reaction at the workpiece cathode, in the plating of an otherwise relatively noble metal as well. So, for example, use of a strongly complexed solution of copper (normal reduction potential about 0.34V vs. NHE), can become negative of the NHE in a sufficiently strong complexed environment.

As indicated, a variety of materials may be used for forming an AGS. In some embodiments, these materials may be similar to those known in the art for dimensionally stable inert electrodes (DSA's). In some embodiments, suitable materials include electrically-conductive, non-corroding or corrosion-resistant materials which do not substantially corrode in the electroplating bath of interest. In certain such embodiments, the corrosion-resistant material may be coated with an oxygen evolving noble catalyst. In some embodiments, the corrosion-resistant underlying substrate material may comprise one or more metals such as, for example, titanium, tantalum, niobium, and zirconium. In some embodiments, a body is formed from one or more of these corrosion resistant materials, and the body is covered (or partially covered) with a catalytic coating capable of promoting the hydrogen ion generating reaction at the AGS (such as by improving the kinetics of $H_2O$ electrolysis). It is important, of course, for the corrosion-resistant material making up the body of the AGS, whether it be a metal or some other type of material, to be compatible with the catalytic coating. The metals listed above are suitably compatible. Appropriate catalytic coatings for enhancing water hydrolysis include platinum, or one or more metal oxides selected from the oxides of platinum, niobium, ruthenium, iridium and tantalum. Suitable catalytic coatings which are commercially available include, but are not limited to, Siemens Optima® anode coatings, which are comprised of mixed metal oxides such as iridium and tantalum oxides (Optima IOA-HF), or platinum (Optima IOA-PTA).

In addition, as indicated above, many configurations are possible for the AGS, in terms of size, shape, placement, orientation, and so forth, and various specific AGS embodiments are disclosed in detail below in the context of FIGS. 3A through 3C. Of course, these embodiments are described in detail in order to illustrate the inventive concepts disclosed herein, with the understanding that these inventive concepts are not to be construed as limited in scope to the specifically described AGS configurations. Since it is the surface of the AGS which enhances the hydrogen ion generating reaction (e.g. by improving the kinetics of $H_2O$ electrolysis), generally a structure with a high surface area per unit volume may be preferred in some instances. In some embodiments, a mesh like structure provides such a high surface area per unit volume. Also note that although the AGS is an anodic surface which functions separately from the usual anodic and cathodic surfaces present in an electroplating cell—i.e. the cathodic wafer substrate and the anodic metal ion source—the AGS may be biased with an anodic electrical potential by sharing the power supplies typically present in an electroplating cell—albeit in some instances with modifications. For instance, as will be described in more detail below, in some embodiments, the AGS may be biased with a positive anodic potential through the same lead and power supply typically providing a negative cathodic bias to the substrate. This may be accomplished, in some instances, by switching or reversing the polarity of the power supply or by using relays to change the connectivity of the power supply to the substrate leads.

Depending on the embodiment, an AGS may be viewed generally in connection with a pH control procedure forming a subpart of method of electroplating a set of substrates, or it may generally be viewed as a pH control related component of a substrate electroplating apparatus. Accordingly, it is useful to provide a description of some of the types of electroplating hardware in which a suitable AGS may be employable. Once again, however, it should be understood that the electroplating apparatuses disclosed below are described in order to illustrate generally, but in concrete terms, various potential AGS related configurations and pH control applications. The specific hardware disclosed is not intended to limit the scope of the disclosed AGS-related inventive concepts.

Figure 1A:
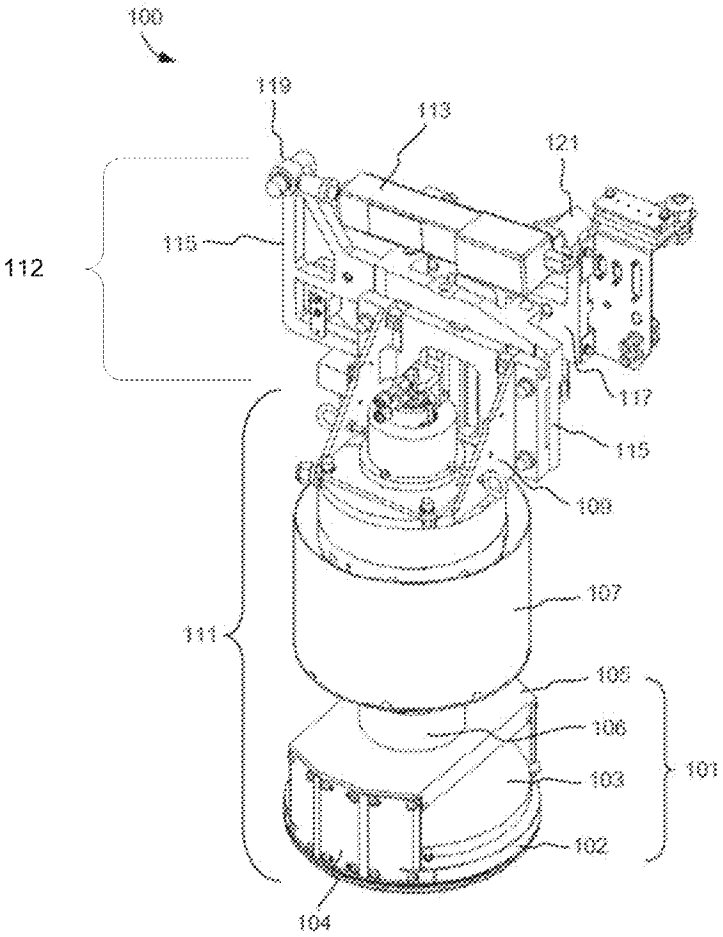
FIG. 1A is a perspective view of a cup/cone clamshell assembly for immersing and holding a semiconductor substrate in an electroplating bath within an electroplating cell.

Accordingly, FIG. 1A provides a perspective view of a substrate holding assembly 100 which is used to immerse and hold a semiconductor substrate in an electroplating bath for electroplating. Substrate holding assembly 100 has various features which are illustrated in FIG. 1A and also described with respect to subsequent figures. To begin with, the substrate holding assembly 100 includes a "clamshell," which is a semiconductor substrate engaging component that includes a cup 102 and also a cone 103 which may clamp a semiconductor substrate securely in the cup 102.

In FIG. 1A, the cup 102 is supported by struts 104, which are connected to a top plate 105. This assembly 102-105, collectively cup/cone assembly 101, is driven by a motor 107, via a spindle 106. Motor 107 is attached to a mounting bracket 109. The spindle 106 transmits torque to a semiconductor substrate (not shown in this figure) being held/engaged by the cup/cone assembly 101 so that the substrate rotates during electroplating. Inside spindle 106 there may be an air cylinder (not visible in FIG. 1A) which provides a vertical force clamping the substrate between the cup 102 and cone 103. The entire assembly of components referenced as 102-109 (which includes the cup/cone assembly) is collectively referred to as substrate holder 111 in FIG. 1A. Note, however, that the concept of a "substrate holder" extends generally to various combinations and sub-combinations of components for engaging/holding a substrate and/or for providing mechanisms for its movement and positioning to enable a electroplating operation.

Also illustrated in FIG. 1A, is a tilting assembly 112, which may include a first plate 115 slidably connected to a second plate 117. The first plate 115 is also connected to a mounting bracket 109 which is located on the distal end of the substrate holder 111. Also illustrated in FIG. 1A is a drive cylinder 113 connected to both the first plate 115 and the second plate 117 at pivot joints 119 and 121, respectively. Thus, the drive cylinder 113 may provide a drive force for sliding plate 115 across plate 117, thus positioning semiconductor substrate holder 111. The distal end of substrate holder 111 (the end having the mounting bracket 109) thus may be moved along an arced path defined by the contact region between plates 115 and 117, and therefore the proximal end of substrate holder 111 having the cup/cone assembly may be tilted with respect to a virtual pivot point. In some embodiments, this allows for the angled entry of the semiconductor substrate into an electroplating bath.

The entire substrate holding assembly 100 is lifted vertically either up or down to immerse the proximal end of substrate holder 111 into an electroplating bath via another actuator (not shown). Thus, a two-component positioning mechanism provides both vertical movement along a trajectory perpendicular to the surface of the electroplating bath fluid, and also a tilting movement allowing the position of the substrate to deviate from a horizontal orientation relative to the liquid surface of the electroplating bath thus providing an angled-substrate immersion capability. A more detailed description of the movement capabilities and associated hardware of apparatus 100 is described in U.S. Pat. No. 6,551,487, filed May 31, 2001, issued Apr. 22, 2003, and titled "METHODS AND APPARATUS FOR CONTROLLED-ANGLE WAFER IMMERSION," which is hereby incorporated herein by reference in its entirety for all purposes.

Note that substrate holding assembly 100 is typically used with an electroplating cell which houses an anode, which during electroplating serves as a counterelectrode to the substrate and also as a source of the metal to be electroplated onto the substrate. This anode may also serve as a counterelectrode to the AGS however, in some embodiments, the AGS may be biased relative to a different counterelectrode. The AGS itself may or may not be formed integrally with the electroplating cell as will be explained in more detail below. In some embodiments, there is a self contained AGS system having its own electrodes, pH meter, power supply and controller, which can communicate with the main plating tool apparatus controller (as needed, e.g. to track wafer or charge passed though a bath). A portion of the elements of the system (i.e. a select list of elements of the system) may be placed in, mounted into, or hung over the wall and into the liquid of the bath (e.g. allowing the immersion of the electrodes and/or pH meters into the bath electrolyte). The select sub-list of element of the system may include 1) an AGS inert dimensionally stable anode 2) a cathode suitable for extracting by plating the metal contained in the bath (e.g. a cathode made of the metal of the bath, or a platinum coated substrate, which can be subsequently plated with the metal of the bath, and later etch of the bath plated metal and undergo regeneration of a exposed Pt surface from time to time), 3) electrical connections to the electrodes, and 4) a pH probe. System parts not immersed in the bath may include a power supply for passing current between the electrodes, a controller in communication with a pH probe that translates the signal of the pH probe to a pH reading that monitors the pH of the bath, as well as take the signal from the probe and determine how and when to control/initiate the power/current to the power supply the current and charge vs. time. The electroplating cell may also include one or more fluidic connectors configured for establishing a fluidic connection between the electroplating cell and an external container serving as a reservoir of electroplating bath fluid. In some embodiments, the AGS and possibly its counterelectrode may be located in this external container. The fluidic connectors may also be configured to circulate the electroplating bath fluid throughout the plating cell and possibly directing it against the surface of the substrate being electroplated. Furthermore, in some embodiments, the electroplating cell may include membranes or other separators designed for fluidically separating, to a certain extent, an anode compartment and a cathode compartment so that different electroplating bath fluid chemistries may be maintained in the two compartments.

Figure 1B:
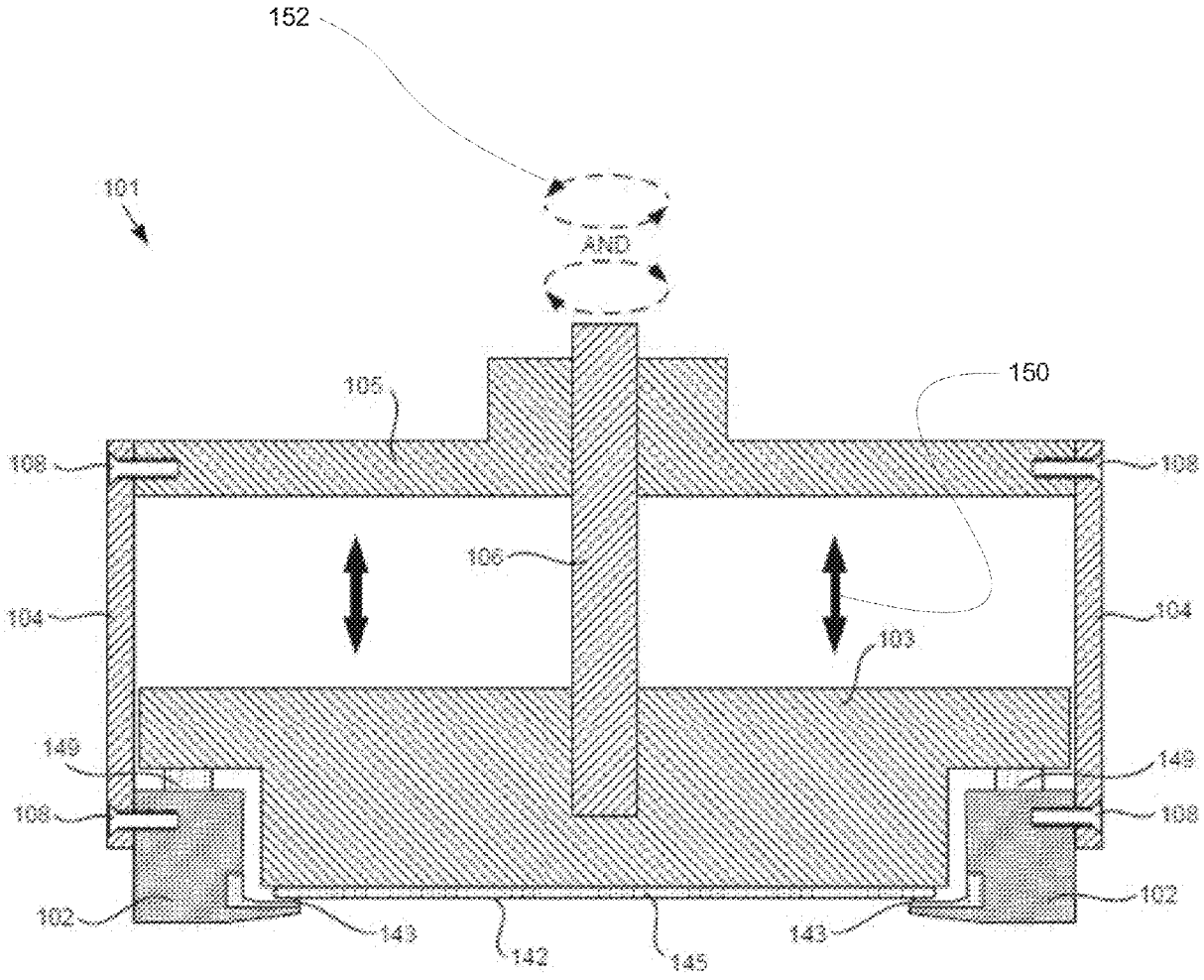
FIG. 1B is a cross-sectional view of a cup/cone clamshell assembly for immersing and holding a semiconductor substrate in an electroplating bath within an electroplating cell.

FIG. 1B provides another detailed schematic of cup/cone assembly 101, this time as a cross-sectional view which includes, for example, cross sections of the cup 102 and cone 103. Note that the cup/cone assembly 101 depicted in FIG. 1B is not intended to be proportionately accurate, but rather is an exhibit stylized to promote the clarity of the following description. Cup 102 is supported by top plate 105 via struts 104, which are attached via screws 108. Generally, a substrate 145 rests on cup 102 which is configured to support it. Cup 102 also includes an opening through which an electroplating bath fluid from the electroplating cell may contact the substrate. Note that the substrate treatment generally takes place on the front side 142 of substrate 145 which, for example, is where the electroplating would occur. Thus, the periphery of substrate 145 rests on the cup 102. Cone 103 presses down on the back side of the substrate 145 to engage it and hold it in place during electroplating. Once engaged, electroplating bath fluid may be generally substantially prevented from contacting the back side of the substrate 145.

To load a substrate 145 into cup/cone assembly 101, cone 103 is lifted from its depicted position via spindle 106 until there is a sufficient gap between the cup 102 and the cone 103 to allow insertion of substrate 145 into the cup/cone assembly 101. The substrate 145 is then inserted, in some embodiments by a robot arm, and allowed to rest lightly on the cup 102 (or on a related component attached to the cup, such as a lip seal 143). In some embodiments, the cone 103 is lifted from its depicted position until it touches top plate 105. Subsequently, the cone 103 is then lowered to press and engage the substrate against the periphery of cup 102 or attached lip seal 143 as depicted in FIG. 1B. In some embodiments, the spindle 106 transmits both a vertical force for causing the cone 103 to engage the substrate 145, and also the torque for rotating the cup/cone assembly 101 as well as the substrate 145 being held by the cup/cone assembly. FIG. 1B indicates the directionality of the vertical force and rotational orientation of the torque by solid arrows 150 and dashed arrows 152, respectively. In some embodiments, the electroplating of the substrate 145 typically occurs while the substrate 145 is rotating. In certain such embodiments, rotating the substrate 145 during electroplating aids in achieving uniform plating.

In some embodiments, such as that depicted in FIG. 1B, cup 102 includes a lip seal 143, which forms a substantially fluid-tight seal against the substrate 145 when cone 103 engages substrate 145. In some embodiments, the lip seal 143 is compressible. In some embodiments, vertical force from the cone 103 presses the substrate 145 against the cup 102 and lip seal 143, compressing the lip seal 143 so as to form a substantially fluid tight seal. Thus, when engaged, the lip seal 143 generally substantially prevents the electroplating bath fluid from reaching and contacting the backside of substrate 145 (where it could contaminate any directly exposed underlying substrate material). This sealing also generally prevents the electroplating bath fluid from contacting the sensitive components of apparatus 101. In some embodiments, there may also be an additional seal 149 located between the cup 102 and the cone 103, which engages the surfaces of the cup 102 and cone 103 to generally form a substantially fluid-tight seal when the cone 103 engages the substrate 145. The additional sealing provided by cup/cone seal 149 functions to further protect the backside of the substrate 145. Cup/cone seal 149 may be affixed to either the cup 102, or to the cone 103, engaging the alternative element when the cone 103 engages the substrate 145. Cup/cone seal 149 may be a single component seal or a multi-component seal. Similarly, lip seal 143 may be a single component seal or a multi-component seal. Furthermore, a variety of materials may be used to construct lip seal 143 and cup/cone seal 149, as would be appreciated by one of ordinary skill in the art (such as, for example, an elastomeric material or more particularly, in certain such embodiments, a perfluoropolymer).

Figure 2:
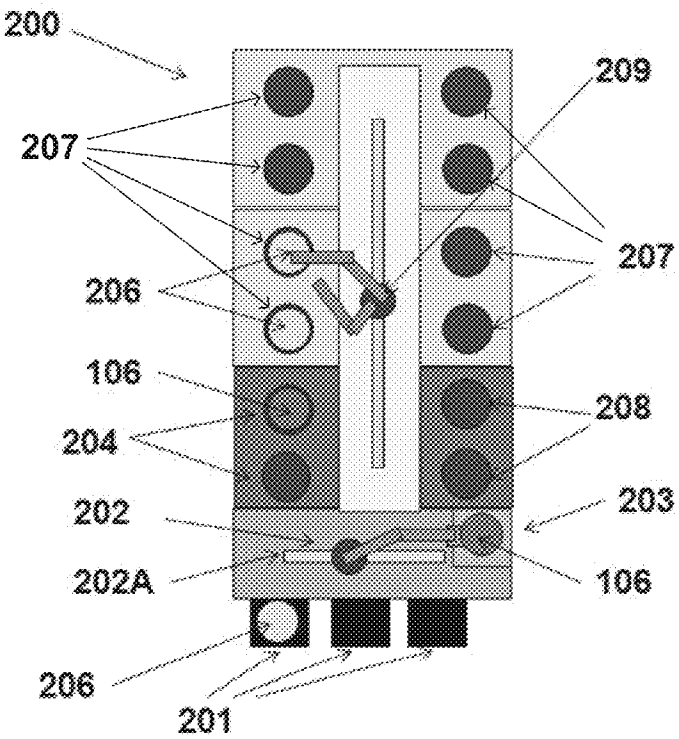
FIG. 2 is a schematic drawing of an automated electroplating apparatus having a set of electroplating cells in a duet configuration.

The substrate holding assembly 100 of FIG. 1A and cup/cone assembly 101 of FIG. 1B, as well as the electroplating cell having an electroplating bath (to which the aforementioned components 100, 101 are inserted during an electroplating operation) may be multiply present forming components of a larger automated electroplating apparatus. Such an automated electroplating apparatus 200 is schematically illustrated in FIG. 2. In this embodiment, the automated electroplating apparatus 200 has a set of electroplating cells 207, each containing an electroplating bath, in a paired or multiple "duet" configuration. In addition to electroplating per se, the automated electroplating apparatus 200 may perform a variety of other electroplating related processes and sub-steps such as spin-rinsing, spin-drying, metal and silicon wet etching, electroless deposition, pre-wetting and pre-chemical treating, photoresist stripping, and surface pre-activation, for example. The automated electroplating apparatus is shown schematically looking top down in FIG. 2, and only a single level or "floor" is revealed in the figure, but it is to be readily understood by one having ordinary skill in the art that such an apparatus, e.g. the Novellus Sabre™ 3D tool, can have two or more levels "stacked" on top of each other, each potentially having identical or different types of processing stations.

Referring once again to FIG. 2, the substrates 206 that are to be electroplated are generally fed to the automated electroplating apparatus 200 through a front end loading "foup" 201 and, in this example, are brought from the foup to the main wafer processing area of the automated electroplating apparatus via a front-end robot 202 that can retract and move a substrate in multiple dimensions from one station to another of the accessible stations—two front-end accessible cleaning agent loading stations 204 and also two front-end accessible spin-rinse-drying (SRD) stations 208 are shown in this example. Lateral movement from side-to-side of the front-end robot 202 is accomplished utilizing robot track 202A.

Of course, also shown in this example are the four "duets" of electroplating cells 207, for a total of 8 electroplating cells 207. The substrate electroplating performed in each of the electroplating baths of these cells 207 may be accompanied by a bath pH maintenance and/or adjustment procedure employing an acid generating surface (AGS) as described above. In some embodiments, a data processing system within or connected to the automated electroplating apparatus 200 tracks the ongoing electroplating taking place within the individual cells 207 as well as the bath composition and/or pH of the bath contained in each cell 207. When the data processing system determines that the pH level of the electroplating bath fluid contained within a particular electroplating cell 207 is (or is likely to be) beyond the necessary and/or desirable pH range, the data processing system may initiate an AGS-based pH adjustment procedure for the given electroplating bath. Considerations the data processing system may rely on when determining whether a given cell is, or is likely to be, out of range include, but are not limited to: one or more direct measurements of the pH level in the particular cell, a count or estimate of the number of substrates plated in the particular cell since the last pH correction procedure was performed, a count or estimate of the total charge transferred through the electroplating processes performed in the particular cell since the last pH correction operation, the amount of time the particular electroplating cell has sat idle since the last pH correction operation, and/or the accumulated MTA charge deficit (as described above) corresponding to the particular electroplating cell. If the data processing system does determine that a cell's bath pH level is, or is likely to be, outside the desirable pH range, the data processing system may or may not initiate an AGS-based pH correction procedure based upon further considerations which may include, but are not limited to, how far a particular cell's bath pH level is outside the desired range and whether or not the particular out-of-range cell is currently electroplating a substrate—if so, likely justifying delaying pH correction at least until completion of this substrate. In some embodiments, the MTA process is carried out for only very short time periods, in parallel with post substrate electroplating steps such as during substrate rinse, reclaim, and substrate removal steps.

Figure 4:
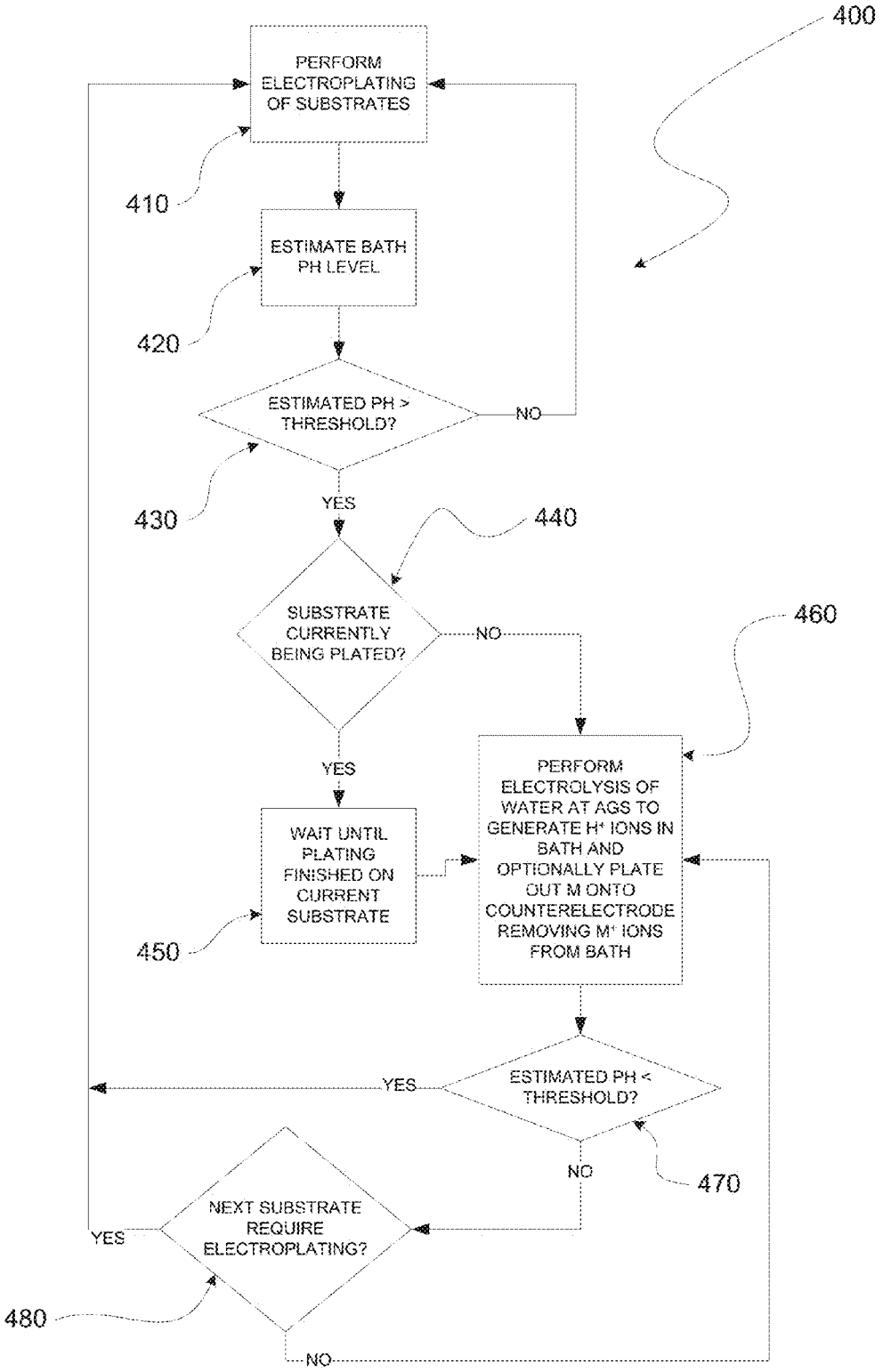
FIG. 4 is a flowchart depicting a method of electroplating and adjusting pH in an electroplating bath involving electrolysis and generation of hydrogen ions at an acid generating surface.

Another set of considerations which may be taken into account by a data processing system in its determination of whether or not to initiate AGS-based pH correction relate to the states of the other cells 207 in the automated electroplating tool apparatus 200. In some embodiments, timing the initiation of AGS-based pH correction with respect to an individual electroplating bath may include the measured bath pH levels of the other electroplating cells 207, the accumulated MTA charge deficit (as described above) of the other electroplating cells 207, the identification of the cell having the electroplating bath with the highest pH or highest MTA charge deficit, whether or not sustaining or achieving acceptable substrate processing throughput demands a substrate be immediately electroplated, and relatedly, whether or not there are any other cells 207 immediately available to accept a substrate for electroplating. The pH adjustment method schematically set forth in FIG. 4 below exemplifies one or more specific methods which take some or all of these considerations into account and could be exercised in reference to the automated electroplating apparatus 200. FIG. 4 will be described in detail below.

If a decision is made within the data processing system to initiate an AGS-based pH adjustment procedure, in some embodiments, the system will begin by designating as temporarily unavailable the cell or cells to be pH corrected. In a multiple-duet configuration, like that shown in FIG. 2, pH adjustment would likely (depending on the embodiment) be performed on both cells in the duet, and so the unavailability designation, once made, would apply to both cells in the duet. After so designated, an AGS-based pH adjustment procedure would be initiated on the designated cells and electroplating postponed. After completion of pH adjustment, with pH level now within an acceptable range, the data processing system would re-designate these cells available for plating, and the cells would remain so designated until these particular cells once again met the criteria for pH adjustment.

While this decision-making with respect to initiation of AGS-based pH correction has been described in the context of a data processing system, it is, of course, readily appreciated by one skilled in the art that the foregoing considerations and decision-making with respect to initiation of AGS-based pH correction may be exercised manually by an operator of any electroplating apparatus having a set of more than one electroplating cell. In some embodiments, it is preferable to automate the decision-making process and analysis of the foregoing considerations using a data processing system as described above, however, in other embodiments, manual analysis and control may be advantageous and preferred.

Another automated electroplating apparatus configuration which may be described in reference to the multiple duet setup illustrated in FIG. 2 involves an electroplating bath reservoir which is shared via fluidic connection by two or more or all of the plating cells 207 in the apparatus. While each cell 207 in FIG. 2 has is own electroplating bath in which electroplating is performed, in some embodiments, a reserve of electroplating bath fluid may be provided to each individual bath via fluidic connection to a common, shared reservoir. The shared plating bath reservoir itself is not shown in FIG. 2 but it may comprises any fluid retaining volume which may be fluidically connected to cells 207—and it may be formed integrally with the automated plating apparatus 200 or it may be a separate freestanding structure fluidically connected to the cells 207 of the apparatus 200 by tubes, pipes, or the like.

In some embodiments employing a shared reservoir, AGS-based pH adjustment procedures may actually take place within the shared reservoir itself, instead of within the individual plating cells 207. In certain such embodiments, this may eliminate the need for individual electroplating cells have their own dedicated AGSs, but more importantly, it may eliminate the need for individual electroplating cells to be taken offline (i.e., designated unavailable for electroplating) in order to have their pH levels brought within the desired range. Thus, in these sorts of configurations, instead of monitoring and adjusting pH levels within individual electroplating cells 207, the pH level of the shared reservoir may be monitored and continuously adjusted as need be without delaying electroplating operations in the individual cells, while at the same time pH levels within the individual cells are maintained within spec by virtue of their fluidic connection to the shared reservoir.

As indicated above, many configurations are possible for the AGS itself, in terms of size, shape, placement, orientation, and so forth. Obviously, it is not possible to provide a detailed description of all the possible configurations which are possible and consistent with the inventive concepts disclosed herein. Accordingly, as also indicated above, the embodiments now described with respect to FIGS. 3A through 3C should be viewed as illustrative and not limiting of the inventive concepts within the scope of the instant disclosure.

Figure 3A:
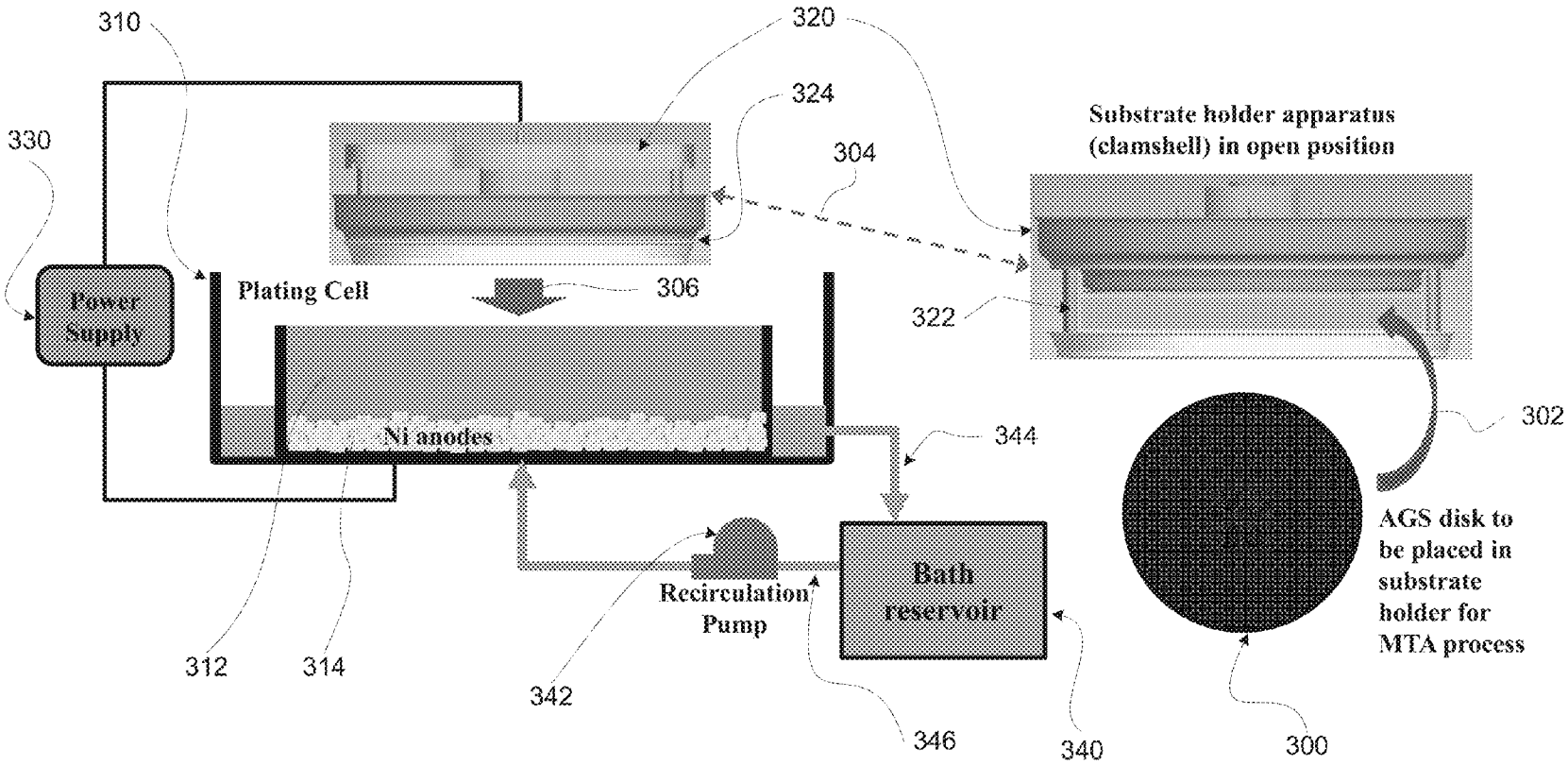
FIG. 3A is a schematic of a cup/cone clamshell assembly, an electroplating cell and bath, and a disc-shaped acid generating surface (AGS) for insertion into the clamshell assembly and immersion into the electroplating bath.

FIG. 3A schematically illustrates one embodiment of an acid generating surface (AGS) which is designed to have a disc-shaped configuration so that it may be inserted into the displayed electroplating cell 310 in place of a semiconductor substrate. In some embodiments, the disc comprises a body with a catalytic coating which, upon application of sufficient positive voltage to the disc, frees hydrogen ions from one or more components of the electroplating bath. In certain such embodiments, hydrogen ions are freed from water molecules through electrolysis at the surface of the catalytic coating. In some embodiments, the body of the disc may comprising an electrically-conductive, corrosion-resistant material which does not substantially corrode in an electroplating bath such as titanium, tantalum, niobium, or zirconium, for example. In some embodiments, the coating may comprise either platinum or one or more metal oxides selected from the oxides of iridium and tantalum. In some embodiments, the disc may have a diameter selected from about 100 mm, 200 mm, 250 mm, 300 mm, 350 mm, 400 mm, and about 450 mm. In some embodiments, a range of diameters may be suitable for the disc wherein the high and low ends of the possible ranges are selected from any combination of the foregoing recited diameters. In some embodiments, the disc may have a thickness selected from about 0.5 mm, 1 mm, 2 mm, 3 mm, 4 mm, and 5 mm. In some embodiments, a range of thicknesses may be suitable for the disc wherein the high and low ends of the possible ranges are selected from any combination of the foregoing recited diameters.

Also shown in FIG. 3A is the cup/cone clamshell assembly 320 into which the AGS disc 300 is to be inserted. In its open configuration 322, the clamshell assembly is ready to accept the AGS disc 300 as indicated by arrow 302 in the figure. After the AGS disc 300 is inserted, the clamshell is manipulated to its closed configuration 324 as indicated by dashed double arrow 304. After being closed, with the AGS disc 300 securely in place, the clamshell assembly 320 is lowered into the plating cell 310 and specifically into the electroplating bath 312 as indicated by arrow 306. At this point, the AGS is in position for execution of a metal-to-acid (MTA) process such as has been described above.

In this embodiment, nickel is the metal being electroplated—hence the nickel anode 314 illustrated in the figure—and so the overall effect of the MTA process will be to exchange $Ni^{2+}$ cations for $H^+$ ions as described in detail above. Furthermore, since in this embodiment, the nickel anode 314 serves as a counterelectrode to the AGS disc 300, the MTA process results in the plating of sold Ni back onto the nickel anode 314, the nickel anode 314 effectively functioning as a cathode. Thus, during the MTA process, the AGS disc 300 will be biased positive relative to the nickel anode 314 (which, again, serves as a cathodic counterelectrode to the AGS during MTA), which opposite to the bias that would be applied to a substrate held in the clamshell during electroplating. Accordingly, the power supply 330 shown in FIG. 3A has the capability of reversing polarity of the voltage difference it applies to the AGS disc and the nickel anode. In FIG. 3A, polarity reversal is schematically viewed as occurring within the power supply 330, however, it is to be understood that an external electrical switching mechanism could be used to provide this reversal of polarity.

Also shown in FIG. 3A are a bath reservoir 340 and recirculation pump 342, which collectively increase the volume of electroplating bath fluid available to the electroplating cell 310. Note, once again, as described above with respect to FIG. 2, a single bath reservoir may provide a reserve volume of electroplating bath fluid to multiple electroplating cells 310 (207 in FIG. 2). In the embodiment displayed in FIG. 3A, despite the presence of the bath reservoir, AGS-based pH adjustment is performed in the plating cell 310 itself.

In some embodiments, the AGS disc 300 illustrated in FIG. 3A may be employed in an automated tool approach. For instance, the AGS disc 300 may be utilized in an MTA process for adjust the pH levels of the individual cells 207 of the automated electroplating apparatus 200 of FIG. 2. Referring to FIG. 2, in certain such embodiments, the AGS disc 300 may be handled like a dummy substrate 206, stored in a substrate holding station 203 of the electroplating apparatus 200 when not in use. When a particular cell 207 is designated for pH correction—based upon the considerations described above in reference to FIG. 2, for example—the AGS disc may be moved via front-end robot 202 from substrate holding station 203 to the particular cell 207 designated for pH correction, and employed in an MTA process to adjust bath pH level in the designated cell 207. After the MTA process concludes, front-end robot 202 may move the AGS disc back to the substrate holding station 203, or to another cell 207 which has been designated for pH correction.

An acid generating surface (AGS) may also be employed as a substantially integral part of an electroplating apparatus, or more specifically, substantially integrally affixed to some internal portion of an electroplating cell. For instance, an AGS may reside within each of the individual electroplating cells 207 of the automated electroplating apparatus displayed in FIG. 2, and thus be in contact with the electroplating bath within each cell 207 and capable of performing a pH adjustment. Accordingly, in general, an electroplating apparatus may be configured such that it includes an electroplating cell configured to contain an electroplating bath, a mount for holding a substrate in the electroplating bath, a substrate electrical contact configured to supply a voltage bias to the substrate while it is held in the mount, a counterelectrode electrical contact configured to supply a voltage bias to a counterelectrode while contacting the counterelectrode, an AGS configured to generate free hydrogen ions in the bath upon supply of sufficient positive voltage bias relative to the counterelectrode electrical contact, and one or more electrical power units configured to supply a negative voltage bias to the substrate electrical contact relative to the counterelectrode electrical contact—sufficient to reduce and plate metal ions from the bath onto the substrate surface—and to supply a positive voltage bias to the AGS relative to the counterelectrode electrical contact—sufficient to generate free hydrogen ions at the AGS.

Figure 3B:
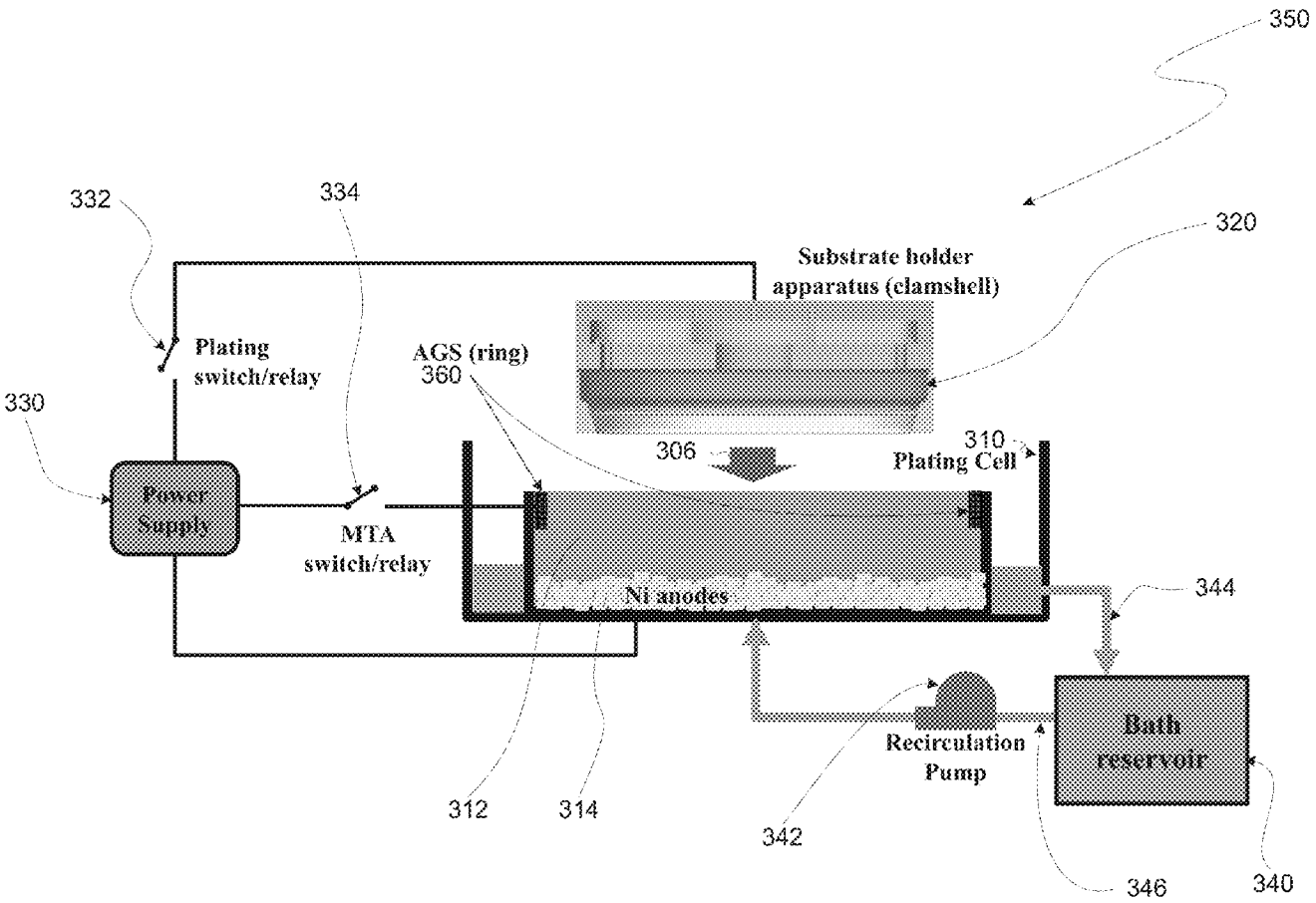
FIG. 3B is a schematic of a cup/cone clamshell assembly, an electroplating cell and bath, and a ring-shaped acid generating surface (AGS) formed in the electroplating cell.

FIG. 3B is a schematic representation of an electroplating apparatus 350 having an integral AGS component 360 for executing pH adjustment procedures. In the figure, the integral AGS component is in the form of an AGS ring 360 attached to an interior wall of the electroplating cell 310. One potential benefit of the ring-shaped AGS 350 exhibited in FIG. 3B is that by virtue of the AGS's radially outward placement in the electroplating cell 310, oxygen gas bubbles generated by this AGS tend to be dispersed radially away from the substrate location, thereby having a reduced likelihood of disturbing the substrate and potentially creating abnormalities on the substrate surface. Thus, in some embodiments, where dispersion of oxygen bubbles is sufficiently complete, the substrate may remain in the bath and separate from the cell during MTA operations. Some embodiments which have a ring-shaped AGS a shown in FIG. 3B may additionally include a membrane above the ring-shaped AGS 350. The membrane may function to further shield the substrate from oxygen bubbles generated at the AGS ring during the MTA process. Other components of the electroplating apparatus 350 exhibited in FIG. 3B include electroplating cell 310, clamshell assembly 320, power supply 330, bath reservoir 340, and recirculation pump 342. Bath reservoir 340 and recirculation pump 342 provide the same functionality as described above with respect to FIG. 3A.

To electroplate a substrate, the clamshell assembly 320 holding the substrate (which is not visible) is lowered (as shown by arrow 306) into the electroplating bath 312, and power supply 330 is used to apply a negative voltage bias to the substrate (via substrate electrical contacts not shown) relative to nickel anode 314 serving as a counterelectrode (via counterelectrode electrical contacts not shown). To perform an MTA pH adjustment procedure as described above, electroplating is concluded, the substrate is raised out of the bath, and a positive voltage bias—i.e. having polarity reversed from that used for electroplating—is applied to the AGS ring 350 relative to the nickel anode 314, causing acid to be generated at the AGS ring 350. In the ring AGS configuration exhibited in FIG. 3B, in addition to increasing bath $H^+$ concentration, execution of the MTA process causes excess $Ni^{2+}$ to be re-deposited back on the nickel anode 314, similar to what occurs with the AGS disc configuration illustrated in FIG. 3A.

In the embodiment shown in FIG. 3B, the positive (i.e., reversed) voltage bias is applied by the same electrical power unit/supply 330 which applied negative voltage bias to the substrate during electroplating. Thus, the electrical power unit/supply 330 exhibited in FIG. 3B functions as a dual-purpose electrical power unit configured to supply negative voltage bias to a substrate electrical contact relative to a counterelectrode electrical contact—in this case the nickel anode 314, and also a positive voltage bias to the AGS ring relative to the nickel anode 314. Furthermore, in some embodiments employing a dual-purpose electrical power unit, the electroplating apparatus may include one or more electrical relays controlling various electrical connections in order to effectuate the application of voltage biases of differing polarities to the AGS and substrate. Thus, in some embodiments, there may be a first relay controlling the electrical connection between the dual-purpose electrical power supply/unit and a substrate electrical contact, and a second relay controlling the electrical connection between the dual-purpose electrical power unit and the AGS. In certain such embodiments, during electroplating, the first relay is closed and the second relay is open so that a negative voltage bias relative to the counterelectrode electrical contact is supplied to the substrate electrical contact, and during the MTA process, the first relay is open and the second relay is closed so that a positive voltage bias relative to the counterelectrode electrical contact is supplied to the acid generating surface. This sort of configuration is schematically illustrated in FIG. 3B wherein the plating relay 332 acts as the aforementioned first relay, and the MTA relay 334 acts as the aforementioned second relay. Note that while use of a single dual-purpose electrical power unit has certain advantages (potentially low cost, compactness, etc.) configurations employing more than one electrical power supply/unit are also possible. For instance, an electroplating apparatus 350 may include a first electrical power unit configured to supply the negative voltage bias to the substrate electrical contact relative to the counterelectrode electrical contact, and a second electrical power unit configured to supply the positive voltage bias to the acid generating surface relative to the counterelectrode electrical contact. A set of electrical relays may also be used to control electrical connections and voltage bias application in a multiple power unit configuration, similar to the manner such relays are employed in FIG. 3B.

In some embodiments, a separate AGS (inert anode) and cathode (counterelectrode) in the bath, controlled by a computer via a monitored bath pH to decide when to turn on and for how long to correct the pH. The bath is in communication with the electrolyte in one of more cells. Bubbles are avoided from being introduced into the cell by allowing them to raise, and/or with a membrane (porous) diverted, around the electrode of the AGS system to prevent the bubbles from getting into the cell flow.

Thus, in some embodiments, an AGS may also be employed in a device having a volume of electroplating bath fluid which is distinct from the fluid volumes contained in the one or more electroplating cells upon which the device performs pH maintenance and/or adjustment. With such an AGS containing pH adjustment device, one or more fluidic connections between the device and the one or more electroplating cells allow exchange of bath fluid so that the hydrogen ions created in the device may be transferred to the one or more cells. Thus, for example, in some embodiments, such a device may be an acid generating bath reservoir (AGBR) which includes a container configured to hold a volume of electroplating bath fluid, a fluidic connector configured for establishing a fluidic connection between the container and an electroplating cell, an AGS and counterelectrode electrical contact disposed with the container, and one or more electrical power units configured to supply a positive voltage bias to the AGS relative to the counterelectrode electrical contact sufficient to generate free hydrogen ions. As with other implementations of AGSs disclosed herein, free hydrogen ions may be generated at the AGS by electrolysis of water molecules, in this case taking place in the volume of electroplating bath fluid within the AGBR. In some embodiments, the fluidic connector between the AGBR and an electroplating cell may include an inlet conduit configured to receive a flow (continuously or periodically) of electroplating bath fluid from the electroplating cell, an outlet conduit configured to send a flow of electroplating bath fluid to the electroplating cell, and a recirculation pump fluidically connected to the inlet and/or outlet conduits and configured to supply fluidic pressure within the inlet and/or outlet conduits. Since such an AGBR is designed to increase hydrogen ion concentration in the electroplating cell or cells to which it is connected, the pH of the electroplating bath fluid flowing within the outlet conduit is generally lower than the pH of the electroplating bath fluid flowing within the inlet conduit (if the AGS is or was turned on). Note that, in some embodiments, an AGBR may be a convenient way to place electrodes (AGS and/or cathodic counterelectrode) in fluidic communication with the electrolyte of an electroplating cell while keeping the bubbles or particles from the electrodes (AGS and/or cathode counterelectrode) from becoming problematic.

Figure 3C:
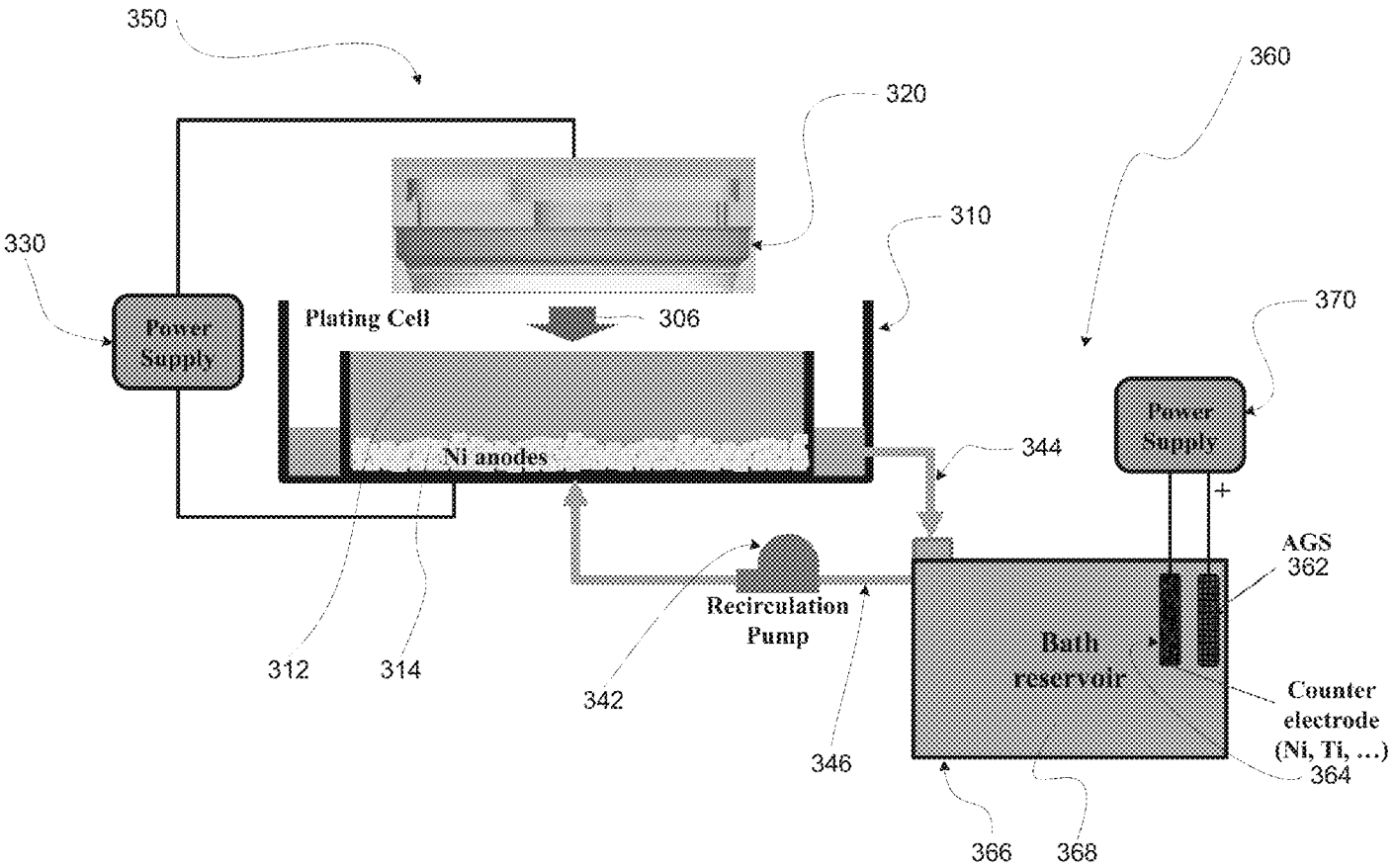
FIG. 3C is a schematic of a cup/cone clamshell assembly, an electroplating cell and bath, an acid generating bath reservoir in fluidic connection with the electroplating cell and bath, and an acid generating surface (AGS) disposed in the bath reservoir.

FIG. 3C displays an AGBR device 360, and the schematic illustrates a number of the foregoing features. In the figure, the AGBR includes a container 366 configured to hold a volume of electroplating bath fluid 368, an AGS 362 and a counterelectrode 364 both disposed within the container and contacting the bath fluid, an electrical power/unit supply 370 configured to apply a positive bias voltage to the AGS 362 relative to the counterelectrode 364 in order to generate hydrogen ions within the bath fluid 368, recirculation pump 342, and fluidic connectors 344 and 346 connecting the AGBR device 360 to an electroplating cell 310. In some embodiments, the counterelectrode, which effectively functions as a cathode, may be comprised of nickel and/or titanium.

The electroplating cell 310 connected to AGBR device 360 in FIG. 3C and its associated components is similar to that schematically illustrated in FIG. 3B. Included in FIG. 3C are clamshell assembly 320, an electroplating bath 312 within the cell 310, a clamshell assembly 320 ready for lowering into the bath 312 (as indicated by arrow 306), a nickel anode 314 within the bath 312, and a power unit/supply 330 configured to supply a negative bias voltage to a substrate (not shown) within the clamshell assembly 320 relative to the nickel anodes 314. One key difference, however, is that the electroplating cell 310 of FIG. 3C does not itself contain an AGS in its interior. Instead pH levels are adjusted and maintained within the electroplating bath 312 through the fluidic connections 344 and 346 with the acid generating bath reservoir 360.

Although FIG. 3C displays an acid generating bath reservoir (AGBR) 360 which is physically separated and free-standing from the electroplating cell 310, in some embodiments, the two may be physically adjacent or attached to one another, as long as the volume of bath fluid contained in the AGBR is distinct from (albeit connected with) the volume contained in the cell 310. Moreover, in some embodiments, the AGBR may actually be located within the electroplating cell 310, once again, as long as the volume of bath fluid contained in the AGBR is distinct from the volume contained in the cell 310. In other embodiments, the AGBR may be placed within an electroplating fluid recirculation loop connected to the cell 310 similar to as shown in FIG. 3C. Accordingly, depending on the configuration, the AGBR may reasonably be viewed a component of an electroplating apparatus 350, whereas in other embodiments it may be viewed as a separate device.

Furthermore, in some embodiments, an AGBR may serve as a component in a multi-cell electroplating apparatus such as the automated electroplating apparatus 200 displayed in FIG. 2. As discussed above, the cells 207 of apparatus 200 may be fluidically connected to a shared electroplating bath reservoir (which is not shown in FIG. 2), and in some embodiments, this shared reservoir may contain an AGS and counterelectrode, such as those shown in FIG. 3C. As explained above, in certain such embodiments, the presence of an AGS and counterelectrode within the shared reservoir may eliminate the need for individual electroplating cells have their own dedicated AGSs. More importantly, it may eliminate the need for individual electroplating cells to forego electroplating operations while their pH levels are brought within the desired range. Accordingly, a shared reservoir which functions as an AGBR in a multi-cell electroplating apparatus may offer certain advantages.

Since an AGBR 360 has an AGS 362 and counterelectrode 364 residing in a volume of electroplating bath fluid 368 distinct from that of the electroplating cell 310 to which it is fluidically connected, an AGBR 360 oftentimes employs its own dedicated auxiliary electrical power supply/unit 370 distinct from the power supply 330 used for electroplating in the cell 310. In some embodiments, employing a dedicated power supply 370 allows an MTA process in the AGBR 360 to be run in parallel (contemporaneously) with an electroplating operation running in electroplating cell 310. However, in some embodiments, a dedicated auxiliary power supply is not necessarily required or even preferred.

For instance, in a multi-cell electroplating apparatus (such as 200 of FIG. 2), if an additional power supply for the AGBR is not economically justifiable, one may be "borrowed" from an electroplating cell (207) which is not currently using its power supply to electroplate the workpiece. This "borrowing" may be accomplished through a system of relay switches capable of connecting a positive lead of the "borrowed" power supply to the AGBR's AGS, and a ground or negative lead of the "borrowed" power supply to the AGBR's counterelectrode. In some embodiments, the data processing system described above in reference to FIG. 2 may be used to carry out the necessary scheduling required to "borrow" the power supply and to activate the appropriate electronic relays and/or switches.

Note, that unlike the AGS implementations discussed above with respect to FIGS. 3A and 3B, in the operation of AGBR 360, excess $Ni^{2+}$ cations present in the electroplating bath 312, while being removed form the bath via the MTA process, they are not re-deposited back onto nickel anode 314 in electroplating cell 310. Instead the $Ni^{2+}$ cations removed from bath 312 are deposited onto counterelectrode 364 within AGBR container 366. However, it is generally the case that the amount nickel which is not recollected onto anode 314 is relatively very small compared with the typical nickel anode's capacity.

Some of the electroplating and pH adjustment methods disclosed herein are related to electroplating semiconductor substrates in a set of electroplating baths, the baths contained in a set of electroplating cells. FIG. 4 is a flowchart depicting one exemplary method 400 of electroplating substrates in a set of electroplating baths, and adjusting the pH levels of the baths. In reference to FIG. 4, the method 400 begins with a step 410 of electroplating a metal onto one or more patterned semiconductor substrates in a set of electroplating baths, followed by a step 420 of estimating the pH level of each of the baths (e.g. by measurement, from MTA charge deficit, etc.). The pH level of each bath may be estimated while electroplating is ongoing in the bath, or it may be estimated between electroplating operations performed on a sequence of substrates. In any event, for each bath whose pH is estimated, in a step 430, the estimated pH level is compared to a threshold value (or alternatively MTA charge deficit is compared to an MTA charge deficit threshold), and if the estimated pH level (or MTA charge deficit) is below the threshold, the electroplating bath is returned to perform electroplating operations. On the other hand, if in step 430, the estimated pH level (or MTA charge deficit) of a particular bath is above the threshold, it is determined in step 440 whether a substrate is currently being plated in that particular bath—if so, it is allowed to finish in step 450—and in any event, thereafter, in step 460 an acid generating operation (and optional plating out of excess metal ions) employing an AGS is performed on the bath. The acid generating operation 460 proceeds until this particular bath's estimated pH level (or MTA charge deficit) is again determined and compared against the threshold in step 470. If the estimated pH level (or MTA charge deficit) is below the threshold, acid generation is concluded and the bath is returned to electroplating operations 410. On the other hand, if the estimated pH level (or MTA charge deficit) is still above the threshold, it is determined in step 480 whether substrate throughput requirements demand that the next substrate be electroplated: if so, the bath is returned to electroplating operations 410 and if not, acid generation 460 is continued in the electroplating bath until it is once again time to estimate bath pH level (or MTA charge deficit) and assess whether the estimated pH level (or MTA charge deficit) is below the threshold. When implemented on a set of multiple baths, the foregoing sequence of operations may provide an efficient mechanism for electroplating and controlling pH levels in the set of multiple baths.

Thus, some methods of electroplating semiconductor substrates in a set of electroplating baths, and adjusting the pH levels of the baths may include electroplating a metal onto one or more substrates, estimating the pH levels of the baths, selecting the bath estimated to have the highest pH level, and initiating a pH correction procedure with respect to the selected bath if the estimated pH level exceeds a threshold maximum pH level. In some embodiments, initiation of the pH correction procedure is postponed until any electroplating currently underway on a particular substrate in the selected bath has completed. The pH correction procedure initiated in the foregoing process includes biasing an AGS sufficiently positive relative to a counterelectrode such that free hydrogen ions are generated at the AGS. In some embodiments, the pH correction procedure is terminated when either it is estimated that the pH level of the selected bath has dropped below a target pH level, or determining that electroplating the next substrate in the selected bath takes precedence over pH correction. In certain such embodiments, it is determined that electroplating the next substrate in the selected bath takes precedence over pH correction whenever there is no other electroplating bath in the set of electroplating baths immediately available for electroplating, and a substrate which has completed the immediately preceding processing step is ready for electroplating.

Example 1

Figure 5C:
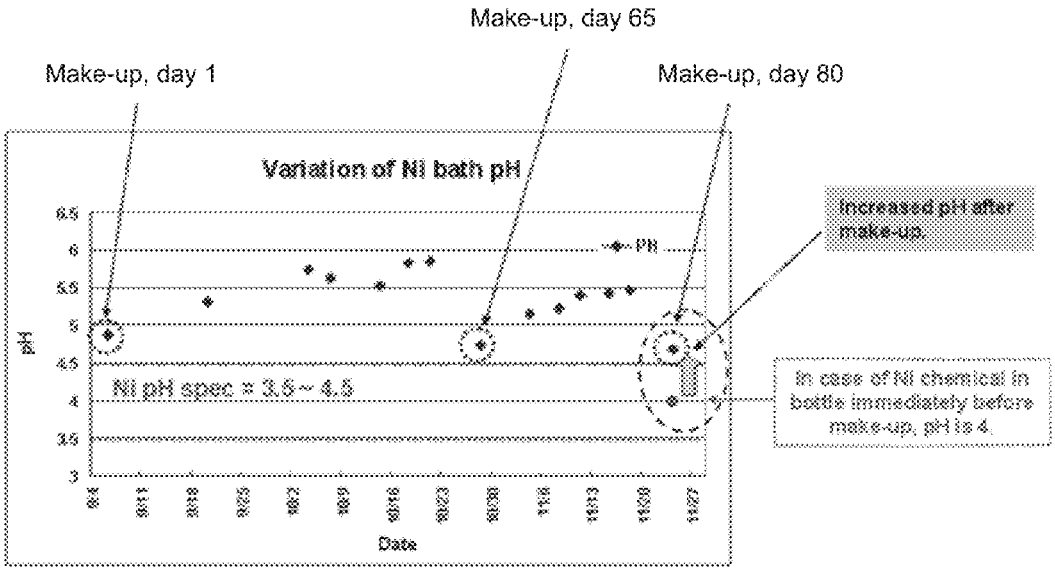
FIG. 5C displays a plot of nickel electroplating bath pH over the course of several months illustrating the tendency of bath pH to drift upwards.

FIG. 5 displays a plot of nickel electroplating bath pH level as a function of time over the course of several months illustrating the tendency of bath pH to drift upwards. The nickel bath chemistry in this example is that of a commercially mainstream electroplating bath oftentimes used for WLP applications.

Example 2

Figure 6:
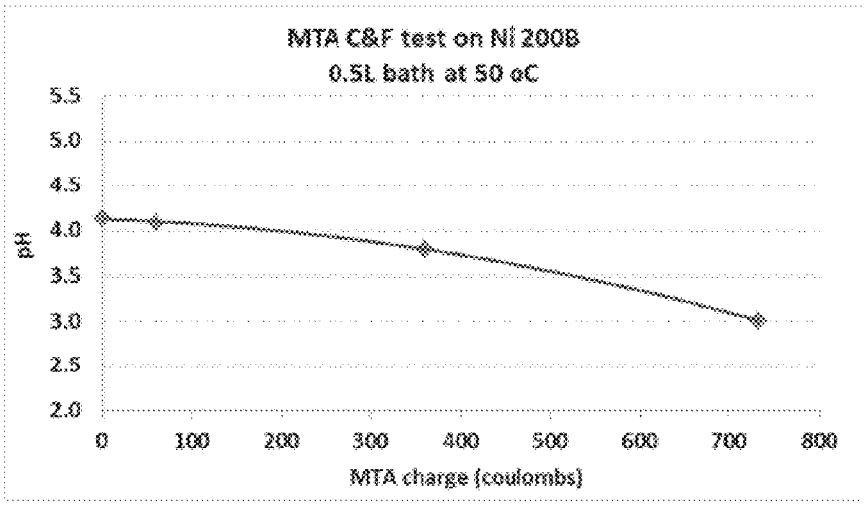
FIG. 6 plots electroplating bath pH level versus accumulated charge in coulombs of a metal to acid process performed in the electroplating bath.

FIG. 6 plots electroplating bath pH level versus accumulated charge in coulombs of an MTA process performed in the electroplating bath, illustrating the lowering of bath pH level through the MTA process. Not shown is the associated reduction in the metal content of the bath during the electrolysis. The data plotted in FIG. 6 is summarized in Table I.

TABLE I

| time min | curent A | Charge C | Accumulated charge C | pH |
|---|---|---|---|---|
| (initial) 0 | NA | 0 | 0 | 4.14 |
| 1 | 1 | 60 | 60 | 4.08 |
| 5 | 1 | 300 | 360 | 3.80 |
| 3.1 | 2 | 372 | 732 | 3.01 |

OTHER EMBODIMENTS

Although the foregoing processes, systems, apparatuses, and compositions have been described in some detail for the purpose of promoting clarity of understanding, it will be apparent to one of ordinary skill in the art that certain changes and modifications may be practiced within the scope of the appended claims. It should be noted that there are many alternative ways of implementing the processes, systems, apparatuses, and compositions disclosed herein. Accordingly, the disclosed embodiments are to be considered as illustrative and not restrictive, and the scope of each appended claims is not to be limited to the specific details of the embodiments described herein.

We claim:

1. A method of electroplating a metal onto a surface of a patterned semiconductor substrate in an electroplating bath and adjusting the pH of the bath, the method comprising:

placing the substrate into an electroplating clamshell and exposing the substrate surface to the bath;

exposing a counter-electrode to the bath;

biasing the substrate surface sufficiently negative relative to the counterelectrode such that metal ions from the bath are reduced and plated onto the substrate surface;

replacing the substrate with an acid generating disc having an acid generating surface in the electroplating clamshell and exposing said surface to the bath; and biasing the acid generating surface sufficiently positive relative to the counterelectrode such that hydrogen ions are generated at the acid generating surface thereby decreasing the pH of the bath.

2. The method of claim 1, wherein the hydrogen ions are generated at the acid generating surface by electrolysis of water molecules in the bath.

3. The method of claim 2, wherein the concentration of metal ions in the bath is lowered through electrochemical reduction of a portion of the metal ions to non-ionic metal which plates onto the counterelectrode.

4. The method of claim 3, wherein the electrochemical reduction of a portion of the metal ions occurs in proportion to the charge transferred by generating hydrogen ions at the acid generating surface.

5. The method of claim 2, wherein the acid generating disc comprises an electrically-conductive, corrosion-resistant material which does not substantially corrode in the electroplating bath, and wherein the electrically-conductive, corrosion-resistant material is coated with either:

platinum; or one or more metal oxides selected from the oxides of platinum, niobium, ruthenium, iridium, and tantalum.

6. The method of claim 5, wherein the electrically-conductive, corrosion-resistant material is titanium, tantalum, niobium, or zirconium.

7. The method of claim 1, wherein the metal is nickel.

8. A method of electroplating patterned semiconductor substrates in a set of electroplating baths, and adjusting the pH levels of the baths, the method comprising:

(i) electroplating a metal onto one or more patterned semiconductor substrates in the set of baths;

(ii) estimating the pH levels of the baths;

(iii) selecting the bath estimated to have the highest pH level;

(iv) if the estimated pH level of the selected bath exceeds a threshold maximum pH level, waiting until any electroplating currently underway with respect to a particular substrate in the selected bath has completed, and thereafter initiating a pH correction procedure with respect to the selected bath, the pH correction procedure comprising:

placing an acid generating disc having an acid generating surface into an electroplating clamshell and exposing said surface to the selected bath; and biasing said acid generating surface sufficiently positive relative to a counterelectrode such that hydrogen ions are generated at the acid generating surface, the hydrogen ions decreasing the pH level of the selected bath; and (v) terminating the pH correction procedure with respect to the selected bath when:

the estimated pH level of the selected bath has dropped below a target pH level; and/or it is determined that electroplating the next substrate in the selected bath takes precedence over pH correction.

9. The method of claim 8, wherein it is determined that electroplating the next substrate in the selected bath takes precedence over pH correction whenever there is no other electroplating bath in the set of electroplating baths immediately available for electroplating, and a substrate which has completed the immediately preceding processing step is ready for electroplating.

10. The method of claim 8, wherein the target pH level is substantially equivalent to the threshold maximum pH level.

11. The method of claim 8, further comprising repeating steps (ii) through (v) one or more times to adjust bath pH levels.

12. The method of claim 8, wherein the hydrogen ions are generated at the acid generating surface by electrolysis of water molecules in the bath.

13. The method of claim 8, wherein the metal is nickel.

14. A method of electroplating patterned semiconductor substrates in a set of electroplating baths, and adjusting the pH levels of the baths, the method comprising:

(i) electroplating a metal onto one or more patterned semiconductor substrates in the set of baths;

(ii) selecting a set of one or more idle baths not currently electroplating a substrate;

(iii) estimating the pH levels of the set of idle baths;

(iv) selecting the subset of the set of idle baths having one or more estimated pH levels exceeding a threshold maximum pH level;

(v) for each particular idle bath in the subset of idle baths estimated to have excessive pH, initiating a pH correction procedure comprising:

placing an acid generating disc having an acid generating surface into an electroplating clamshell and exposing said surface to the particular idle bath; and biasing said acid generating surface sufficiently positive relative to a counterelectrode such that hydrogen ions are generated at the acid generating surface, the hydrogen ions decreasing the pH level of the particular idle bath; and (vi) for each particular idle bath in the subset of idle bath estimated to have excessive pH, terminating the pH correction procedure with respect to it when:

the estimated pH level of the particular idle bath has dropped below a target pH level; and/or it is determined that electroplating the next substrate in the particular idle bath takes precedence over pH correction.

15. The method of claim 14, wherein it is determined that electroplating the next substrate in the particular idle bath takes precedence over pH correction whenever there is a substrate ready for electroplating and:

the particular idle bath is the only idle bath; or the particular idle bath has an estimated pH level lower than the other baths of the subset of idle baths estimated to have excessive pH.

* * * * *